US009090065B2

(12) United States Patent
Teshigawara et al.

(10) Patent No.: US 9,090,065 B2
(45) Date of Patent: Jul. 28, 2015

(54) INK JET PRINTING APPARATUS AND INK JET PRINTING METHOD

(71) Applicant: CANON KABUSHIKI KAISHA, Tokyo (JP)

(72) Inventors: Minoru Teshigawara, Yokohama (JP); Kiichiro Takahashi, Yokohama (JP); Tetsuya Edamura, Kawasaki (JP); Akiko Maru, Tokyo (JP); Yoshiaki Murayama, Tokyo (JP); Takatoshi Nakano, Tokyo (JP); Hiroshi Taira, Chofu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/891,489

(22) Filed: May 10, 2013

(65) Prior Publication Data

US 2013/0241997 A1 Sep. 19, 2013

Related U.S. Application Data

(63) Continuation of application No. 12/168,429, filed on Jul. 7, 2008, now abandoned.

(30) Foreign Application Priority Data

Jul. 10, 2007 (JP) ..... 2007-181352

(51) Int. Cl.
*B41J 2/145* (2006.01)
*G03G 15/10* (2006.01)

(52) U.S. Cl.
CPC ..... *B41J 2/145* (2013.01); *G03G 15/104* (2013.01); *G03G 2215/0658* (2013.01)

(58) Field of Classification Search
CPC ..... B41J 2/145
USPC ..... 347/6, 12, 41
See application file for complete search history.

(56) References Cited

U.S. PATENT DOCUMENTS 5,594,478 A 1/1997 Matsubara et al.
5,604,520 A 2/1997 Matsubara et al.
5,633,663 A 5/1997 Matsubara et al.

(Continued)

FOREIGN PATENT DOCUMENTS

JP 5-318770 A 12/1993
JP 7-125311 A 5/1995

(Continued)

OTHER PUBLICATIONS

Japanese Office Action issued in the counterpart application No. 2008-180209 dated Jun. 5, 2012, along with its English-language translation—8 pages.

*Primary Examiner* — Daniel Petkovsek
(74) *Attorney, Agent, or Firm* — Fitzpatrick, Cella, Harper & Scinto

(57) ABSTRACT

The present invention provides an ink jet printing apparatus and an ink jet printing method which are based on the multi-pass printing method using a print head having a plurality of nozzle rows and which enables a reduction in the number of nozzles to be simultaneously driven, allowing ink to be stably ejected. On the basis of the multi-pass printing method of dividing print data into a plurality of pieces by using mask patterns, the mask patterns are offset according to the positional relationship between the plurality of nozzle rows in the print head.

11 Claims, 31 Drawing Sheets

(56) References Cited

U.S. PATENT DOCUMENTS

| | | | | |
|---|---|---|---|---|
| 5,831,642 | A | 11/1998 | Matsubara et al. | |
| 6,019,454 | A * | 2/2000 | Serra et al. | 347/41 |
| 6,130,685 | A | 10/2000 | Matsubara et al. | |
| 6,250,737 | B1 | 6/2001 | Matsubara et al. | |
| 6,254,217 | B1 * | 7/2001 | Askeland et al. | 347/43 |
| 6,322,197 | B1 * | 11/2001 | Yanaka | 347/41 |
| 6,426,765 | B1 | 7/2002 | Iwasaki et al. | |
| 6,601,939 | B2 | 8/2003 | Fujita et al. | |
| 6,626,517 | B2 | 9/2003 | Iwasaki et al. | |
| 6,755,496 | B2 | 6/2004 | Nishikori et al. | |
| 6,779,873 | B2 | 8/2004 | Maeda et al. | |
| 6,789,867 | B2 | 9/2004 | Takahashi et al. | |
| 6,832,825 | B1 | 12/2004 | Nishikori et al. | |
| 6,846,066 | B2 | 1/2005 | Teshikawara et al. | |
| 6,874,864 | B1 | 4/2005 | Maeda et al. | |
| 7,210,754 | B2 * | 5/2007 | Tatsumi | 347/6 |
| 2004/0090480 | A1 | 5/2004 | Teshikawara et al. | |

FOREIGN PATENT DOCUMENTS

| | | | |
|---|---|---|---|
| JP | 2004-148723 | A | 5/2004 |
| JP | 2006-110958 | A | 4/2006 |

* cited by examiner

| LEVEL OF QUANTIZED DATA | NUMBER OF SMALL DOTS FORMED | NUMBER OF LARGE DOTS FORMED | DOT MATRIX PATTERN |
|---|---|---|---|
| LEVEL 1 | 1 | 0 |  |
| LEVEL 2 | 2 | 0 |  |
| LEVEL 3 | 1 | 1 |  |
| LEVEL 4 | 0 | 2 |  |

INK JET PRINTING APPARATUS AND INK JET PRINTING METHOD

The present application is a continuation of U.S. application Ser. No. 12/168,429, filed on Jul. 7, 2008, the entire disclosure of which is incorporated by reference herein.

BACKGROUND OF THE INVENTION

1. Field of the Invention

The present invention relates to what is called a serial scan type inkjet printing apparatus that prints images using a print head that can eject ink, and a relevant ink jet printing method.

2. Description of the Related Art

A printing apparatus based on an ink jet method (hereinafter referred to as an "ink jet printing apparatus") ejects ink from a print head onto a print medium for printing. The ink jet method allows definition to be increased more easily than the other printing methods. Furthermore, the ink jet printing apparatus advantageously operates fast and silently and is inexpensive. In particular, a demand for color image printing has recently been increasing, and ink jet printing apparatuses have been developed which can print high-quality images that are comparable to silver photographs. These printing apparatuses use a print head having a plurality of nozzles integrally arranged therein in order to improve print speed.

As an ink jet printing apparatuses of what is called the serial scan type, which prints images by moving a print head in a main scanning direction and conveying a print medium in a sub-scanning direction, an ink jet printing apparatus is known which adopts what is called a multi-pass printing method in order to print high-quality images. The multi-pass printing method completes an image in a predetermined print area by allowing the print head to perform a plurality of scans (a plurality of passes). During each of the scans, the print head ejects ink on the basis of print data shinned out by using a mask pattern. According to Japanese Patent Laid-Open No. 5-318770, mask patterns are prepared in association with the number of passes and are in an exclusively complementary relationship. If a print head is used which has a plurality of nozzle rows arranged in parallel and adjoined each other in the main scanning direction, each of the nozzle rows is associated with a plurality of mask patterns.

Furthermore, a known method of driving the plurality of nozzles forming each nozzle row is what is called a block driving method of dividing the nozzles into a plurality of blocks so as to vary a timing for ejecting ink among the blocks. The block driving method enables a reduction in the number of nozzles to be simultaneously driven and thus in a variation in driving voltage. The ink can thus be stably ejected. If a print head is used which has a plurality of nozzle rows arranged in parallel and adjoined in the main scanning direction, the nozzle rows are individually subjected to block driving.

With the ink jet printing apparatus based on the multi-pass printing method, the mask patterns are sequentially read from a specified address at an ink ejection timing when the nozzle rows in the print head moving in the main scanning direction are positioned over a print area on the print medium. For example, if a print head is used which has two nozzle rows arranged in parallel and adjoined in the main scanning direction, one of the nozzle rows is first positioned over the print area and the other is then positioned over the print area. Thus, reading timings for the mask patterns corresponding to the two nozzle rows are different from each other.

For example, it is assumed that with a 4-pass printing method in which each of the two nozzle rows uses four mask patterns A, B, C, and D, during the same print scan, one of the nozzle rows uses the mask pattern A, whereas the other uses the mask pattern B. If the timing for starting a read operation from the specified address is the same for the mask patterns A and B, the exclusively complementary relationship between the mask patterns A and B is maintained at every timing. However, if the timing for starting the read operation varies between the mask patterns A and B depending on the positions of the two nozzle rows, the exclusively complementary relationship between the mask patterns A and B may not be maintained at a certain timing.

With the ink jet printing apparatus based on such a multi-pass printing method, it is further assumed that the two nozzle rows are divided into the same number of blocks for block driving. In this case, provided that the exclusively complementary relationship between the mask patterns A and B is maintained at every timing, the nozzles in the nozzle rows which belong to the same driving block are not simultaneously driven. However, if the exclusively complementary relationship between the mask patterns A and B fails to be maintained at a certain timing, the nozzles in the nozzle rows which belong to the same driving block may be simultaneously driven.

Thus, with the printing apparatus using the print head that can eject ink through the plurality of nozzle rows, the combination of the multi-pass printing method and the block driving method may cause the nozzles in the nozzle rows which belong to the same driving block to be simultaneously driven. Thus, with an increase in the number of nozzles belonging to the same driving block and which are simultaneously driven, it may be impossible to make full use of the advantages of the block driving method.

SUMMARY OF THE INVENTION

The present invention provides an ink jet printing apparatus and an ink jet printing method which are based on the multi-pass printing method using a print head having a plurality of nozzle rows and which enables a reduction in the number of nozzles to be simultaneously driven, allowing ink to be stably ejected.

In the first aspect of the present invention, there is provided an ink jet printing apparatus printing an image on a print medium by repeatedly performing a print scan using a print head and a conveying operation, a print head being capable of ejecting ink from a plurality of nozzles arrayed in a first nozzle row and a second nozzle row, in the print scan, the print head ejecting ink through the nozzles in the first and second nozzle rows while being moved in a main scanning direction, and in the conveying operation, the print medium being conveyed in a sub-scanning direction crossing the main scanning direction, the apparatus comprising: a dividing unit that divides print data corresponding to each of the first and second nozzle rows into a plurality of pieces by using a plurality of mask patterns, in order to allow an image to be printed, over a plurality of print scans, in a print area on the print medium which can be printed during one print scan; and a control unit that allows the ink to be ejected through the nozzles in the first and second nozzle rows on the basis of the divided print data, wherein the dividing unit performs an operation such that during the same print scan, a first mask pattern of the plurality of mask patterns used to provide the print data corresponding to the first nozzle row is different from a second mask pattern of the plurality of mask patterns used to provide the print data corresponding to the second nozzle row, and the driving unit displaces at least one of the first mask pattern and the second mask pattern in a raster direction corresponding to the main scanning direction, according to a driving condition for the first and second nozzle rows.

In the second aspect of the present invention, there is provided an ink jet printing apparatus printing an image on a print medium by allowing a print head capable of ejecting ink from a plurality of nozzles arrayed in a first nozzle row and a second nozzle row to scan a unit area on the print medium a plurality of times, while driving the plurality of nozzles in the first and second nozzle rows for each block on a time division basis, the apparatus comprising: a dividing unit that divides print data to be printed in the unit area for each of the first and second nozzle rows into a plurality of pieces corresponding to a plurality of print scans, by using a plurality of patterns; and a control unit that allows the ink to be ejected through the nozzles in the first and second nozzle rows on the basis of the divided print data, wherein the dividing unit changes a plurality of patterns used to provide the print data to be printed in the unit area for each of the first and second nozzle rows, according to amount of displacement between the first and second nozzle rows so as to reduce number of nozzles in the first and second nozzle rows which are simultaneously driven.

In the third aspect of the present invention, there is provided an ink jet printing apparatus printing an image on a print medium by allowing a print head capable of ejecting ink from a plurality of nozzles arrayed in a first nozzle row and a second nozzle row to scan a unit area on the print medium a plurality of times, while driving the plurality of nozzles in the first and second nozzle rows for each block on a time division basis, the apparatus comprising: a dividing unit that divides print data to be printed in the unit area for each of the first and second nozzle rows into a plurality of pieces corresponding to a plurality of print scans, by using a plurality of patterns; a control unit that allows the ink to be ejected through the nozzles in the first and second nozzle rows on the basis of the divided print data, and an adjusting unit that adjusts a print position of the first nozzle row according to amount of relative displacement of a print position of the second nozzle row from the print position of the first nozzle row, wherein after the adjusting unit adjusts the relative print positions of the first and second nozzle rows, the dividing unit changes a plurality of patterns used to provide the print data to be printed in the unit area for each of the first and second nozzle rows, according to amount of displacement between the print positions of the first and second nozzle rows so as to reduce number of nozzles in the first and second nozzle rows which are simultaneously driven.

In the fourth aspect of the present invention, there is provided an ink jet printing method of printing an image on a print medium by repeatedly performing a print scan using a print head and a conveying operation, a print head being capable of ejecting ink from a plurality of nozzles arrayed in a first nozzle row and a second nozzle row, in the print scan, the print head ejecting ink through the nozzles in the first and second nozzle rows while being moved in a main scanning direction, and in the conveying operation, the print medium being conveyed in a sub-scanning direction crossing the main scanning direction, the method comprising: a print data dividing step of dividing print data corresponding to each of the first and second nozzle rows into a plurality of pieces by using a plurality of mask patterns that are in a complementary relationship, in order to allow an image to be printed, over a plurality of print scans, in a print area on the print medium which can be printed during one print scan; and a control step of allowing the ink to be ejected through the nozzles in the first and second nozzle rows on the basis of the divided print data, wherein the control step performs an operation such that during the same print scan, a first mask pattern of the plurality of mask patterns used to provide the print data corresponding to the first nozzle row is different from a second mask pattern of the plurality of mask patterns used to provide the print data corresponding to the second nozzle row, and the control step displaces at least one of the first mask pattern and the second mask pattern in a raster direction corresponding to the main scanning direction, according to a driving condition for the first and second nozzle rows.

The present invention is based on the multi-pass printing method of using the mask patterns to divide the print data, and offsets the mask patterns according to the positional relationship among the plurality of nozzle rows in the print head. The present invention can thus reduce the number of nozzles to be simultaneously driven. As a result, the nozzles in the plurality of nozzle rows are reliably driven to stabilize the capability of ejecting ink. Appropriate images can thus be printed.

Further features of the present invention will become apparent from the following description of exemplary embodiments (with reference to the attached drawings).

DESCRIPTION OF THE EMBODIMENTS

Embodiments of the present invention will be described below in detail with reference to the drawings.

First Embodiment

Figure 1:
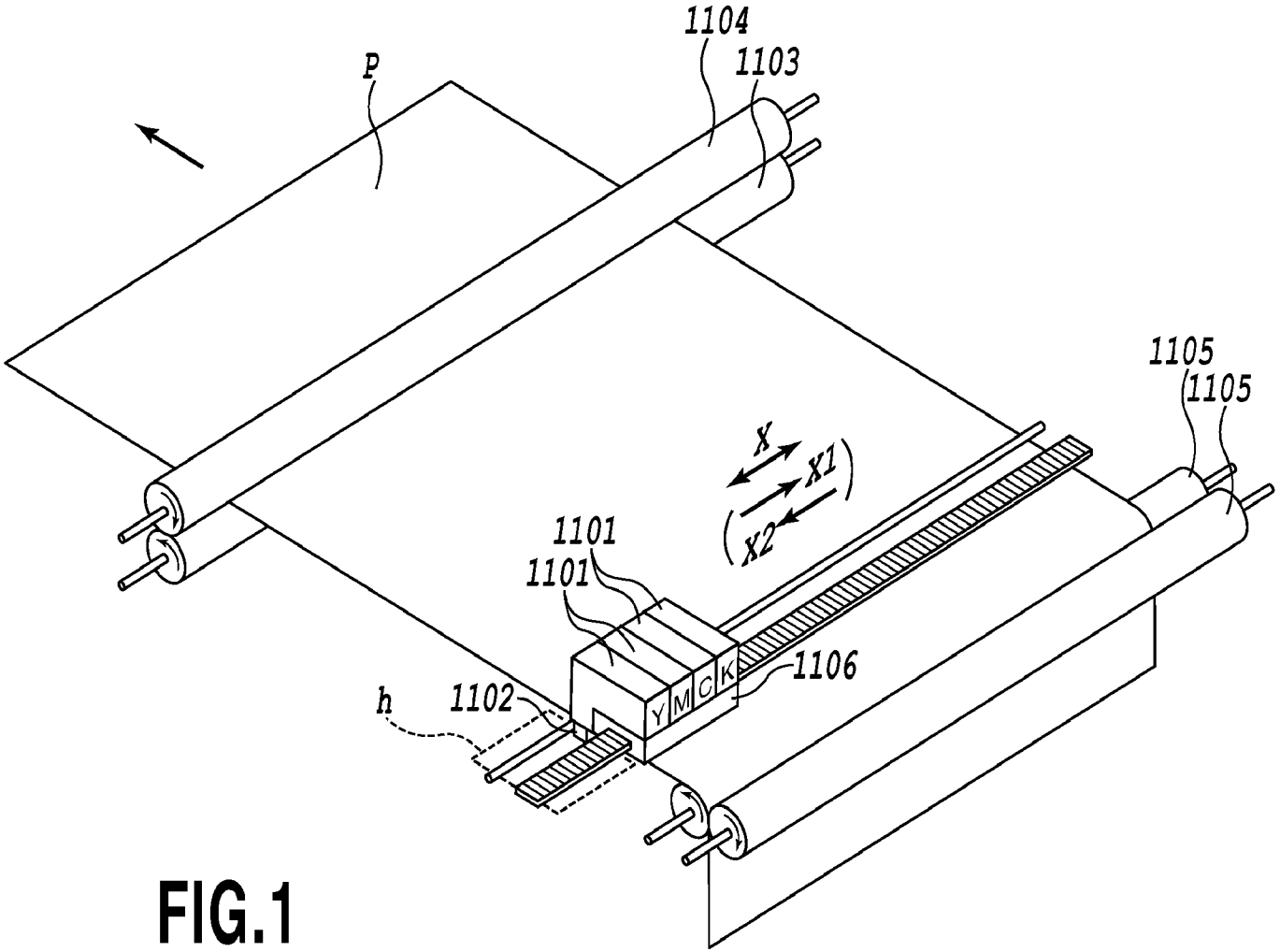
FIG. 1 is a perspective view of an essential part of an ink jet printing apparatus according to a first embodiment of the present invention.

FIG. 1 is a perspective view of an essential part of a serial scan type ink jet printing apparatus to which the present invention is applicable.

Figure 2:
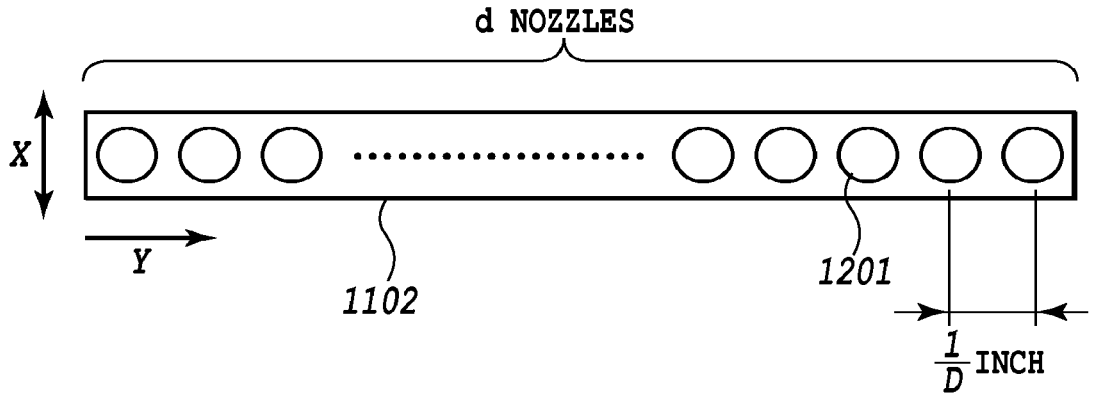
FIG. 2 is a diagram illustrating the arrangement of nozzles in a print head.

In FIG. 1, reference numeral 1101 denotes each of four ink jet cartridges. Each of the ink jet cartridges 1101 is composed of an ink tank in which a corresponding one of four color inks, that is, black ink, cyan ink, magenta ink, and yellow ink is stored, and a print head 1102 corresponding to the ink. FIG. 2 is a schematic diagram of ejection ports (hereinafter referred to as "nozzles") 1201 for one color disposed on one print head 1102 as viewed from a print medium P. The print head 1102 has d ejection ports 1201 arranged thereon at a nozzle density (Ddpi) of D nozzles per inch. The print head 1102 can eject ink using electrothermal converter (heater) or piezo element. When the electrothermal converter is used, heat from the electrothermal converter is used to bubble the ink so that the resulting bubbling energy is utilized to eject the ink through the ejection port 1201.

In FIG. 1, reference numeral 1103 denotes a sheet conveying roller. The sheet conveying roller 1103 rotates in the direction of an arrow in the figure while sandwiching a print medium P between the sheet conveying roller 1103 and an auxiliary roller 1104. The print medium P is thus conveyed in a Y direction (sub-scanning direction) crossing a main scanning direction (in the present example, orthogonal to the main scanning direction). Reference numeral 1105 denotes a pair of sheet feeding rollers that rotate in the direction of the arrow to feed the print medium P. The paired sheet feeding rollers 1105 rotate with the print medium P sandwiched therebetween similarly to the rollers 1103 and 1104. The rotation speed of the sheet feeding rollers 1105 is slightly lower than that of the sheet conveying roller 1103. Thus, an appropriate magnitude of tension can be applied to the print medium P.

Reference numeral 1106 denotes a carriage on which the four ink jet cartridges 1101 can be mounted. During printing, the carriage moves in the main scanning direction together with the ink jet cartridges 1101. The carriage 1106 moves to a home position h shown by a dashed line in FIG. 1 where the carriage 1106 stands by while printing is not being performed, or the carriage 1106 moves to the home position h in order to execute a process of recovering the print head 1102.

When a print start instruction is input to the printing apparatus, the carriage 1106 standing by at the home position h moves in the X direction (main scanning direction) together with the print head 1102. While moving in the main scanning direction together with the carriage 1106, the print head 1102 ejects ink through the nozzles 1201 at a predetermined frequency to form an image of width d/D inch on the print medium P. After the first print scan is completed and before the second print scan is started, the sheet conveying roller 1103 rotates in the direction of the arrow to convey the print medium P in the Y direction (sub-scanning direction) by a predetermined amount.

Repeating such print scans and conveying operations enables an image to be sequentially formed on the print medium P.

The ink jet printing apparatus often adopts a multi-pass printing method. The multi-pass printing method will be described below.

The multi-pass printing method requires a plurality of print scans to print data that can otherwise be printed during one print scan. That is, a plurality of print scans are required to print an image in a print area on the print medium which can otherwise be printed during one print scan. To accomplish this, the print data that can otherwise be printed during one print scan is thinned out into a plurality of print data by using a plurality of complementary mask patterns (print data division).

For example, for multi-pass printing with two passes, print data that can be printed during one print scan is printed in two print scans. In this case, the mask patterns used for the first and second print scans each thin out the print data to about 50% and are exclusively complementary. During the interval between these print scans, the print medium P is conveyed by half of d/D. In an image printed by repeating such a printing operation, an ink dot formed on a line along the main scanning direction is formed by ink ejected through the nozzle that is changed between the first print scan and the second print scan. In this manner, each of the ink dots arranged in the main scanning direction is formed by the two different nozzles. Consequently, even if the individual nozzles vary slightly, the variation is distributed to half on the print medium P. Therefore, the multi-pass printing enables the printing of smoother images than one-pass printing.

Furthermore, multi-pass printing with four passes uses four complementary mask patterns, a first mask pattern to a fourth mask pattern, and performs the first print scan on the basis of print data thinned out by using the first mask pattern. Subsequently, the second, third, and fourth print scans are sequentially performed on the basis of print data thinned out by using the second, third, and fourth mask patterns, respectively. During the interval between the print scans, the print medium P is conveyed by an amount (for the multi-pass printing, a quarter of d/D) smaller than the print width (d/D inch) of the print head.

With the multi-pass printing, increasing the number of passes (the number of divisions) allows a smoother image to be printed. However, an increase in the number of passes (divisions) increases the number of required print scans and conveying operations and thus the time required for printing.

Figure 3:
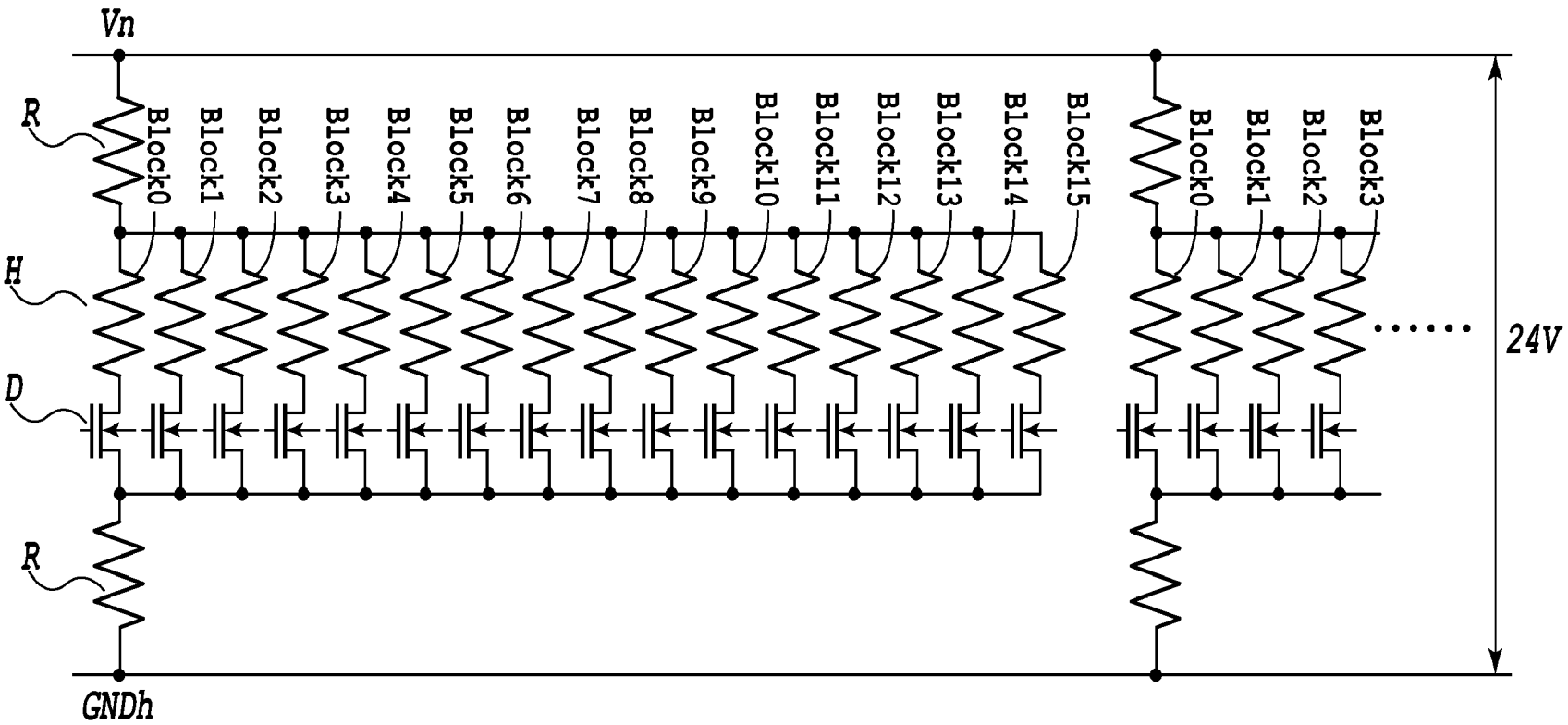
FIG. 3 is a diagram of the configuration of a circuit for the print head for block driving.

FIG. 3 is a diagram illustrating wiring required to implement a driving method of varying a driving timing among a plurality of ink ejecting heaters (electrothermal converters) in the print head, that is, a block driving method (time division driving). In the print head in FIG. 3, heaters H are driven by 16 time division timings. To accomplish this, the heaters H corresponding to the plurality of ejection ports arranged in a raster direction (sub-scanning direction) are divided into 16 blocks (block 0 to block 15). The heaters H are connected such that the heaters arranged in the raster direction at equal intervals of 16 heater belong to the same block. Thus, the different blocks are driven at different timings. Consequently, to print a vertical line extending in the raster direction, over a width equal to one column, the period of the column is divided into 16 pieces and the heaters H for the blocks 0 to 15 are sequentially driven. For example, if the print head has 128 nozzles in a row, the heaters that are driven at the same timing correspond to a maximum of eight nozzles (=128 nozzles÷16 (time divisions)). In FIG. 3, R denotes power supply wiring resistance, and D denotes a driver. A power supply voltage VH is 24 V.

The number of heaters H to be simultaneously driven (turned on) depends on print data. Thus, the voltage applied to the heaters H varies; the heaters H are arranged in parallel with respect to a power supply line. To absorb the variation in voltage, it is possible to pre-count the number of data used to simultaneously drive the heaters H and to vary the width of driving pulses to the heaters depending on the count value.

Figure 4:
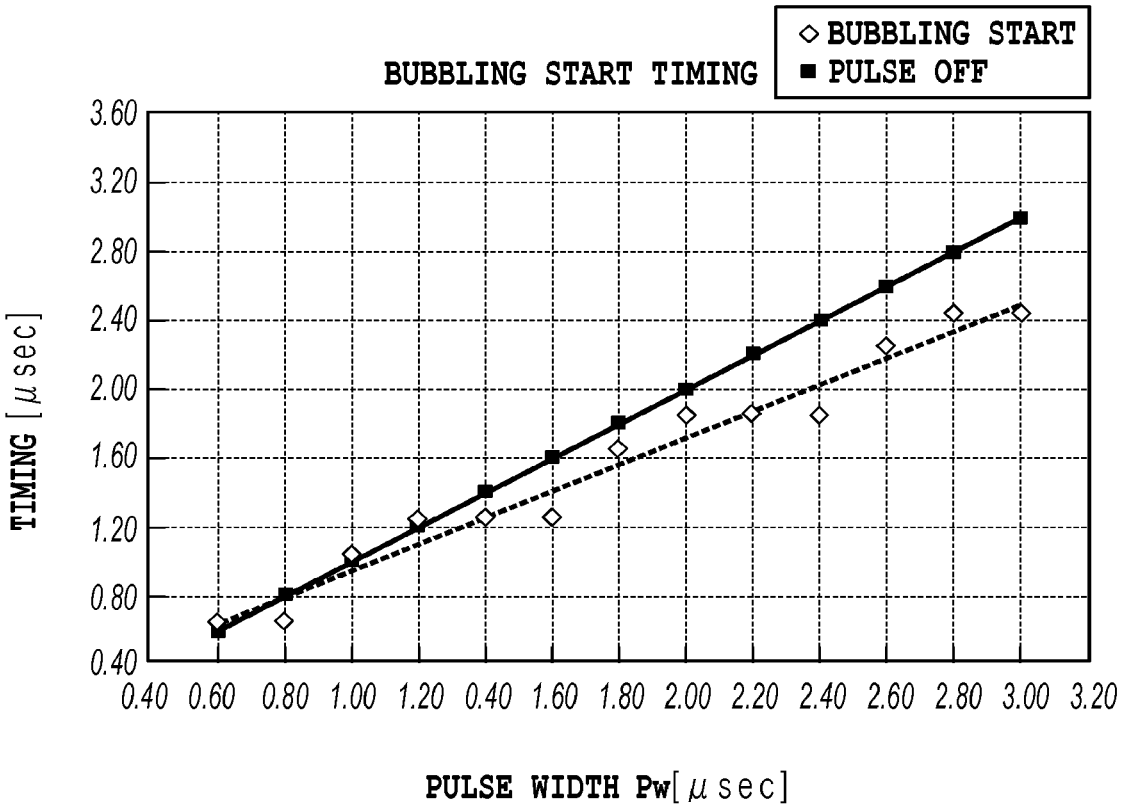
FIG. 4 is a diagram illustrating timings for the start of bubbling that allows ink to be ejected through the nozzles in the print head.

FIG. 4 is a diagram illustrating the experimentally determined relationship between the width of a driving pulse used to drive the ink ejecting heaters, a timing for starting ink bubbling, and a timing for turning off the driving pulse. The voltage of the driving pulse is determined by multiplying a bubbling threshold voltage required to bubble the ink, by 1.15. Sufficient energy was thus applied to the heaters.

The difference between the bubbling start timing and the driving pulse off timing increased gradually as the pulse width of the driving pulse increase.

It is assumed that the increased pulse width reduces a heat flux to moderately raise the surface temperature of the heaters to make the distribution of the temperature in the heater surface nonuniform, resulting in the relative delay of the bubbling start timing. The nonuniform distribution of the temperature in the heater surface makes the bubbling of the ink unstable to vary a speed at which main droplet of the ink are ejected. Furthermore, if a deforming process of the bubble is also affected, the condition of a backward surface to which an ink meniscus moves backward may become unstable to affect a direction in which sub-droplets (satellites) of the ink are ejected. In view of this, the ink can be stably ejected by driving the heaters such that the heat flux is maximized, that is, driving the heaters using a driving pulse with a short pulse width.

That is, to allow the ink to be stably ejected, it is desirable to reduce the number of heaters to be simultaneously driven to maintain a short driving pulse width rather than increasing the driving pulse width according to the number of heaters to be simultaneously driven.

Figure 5:
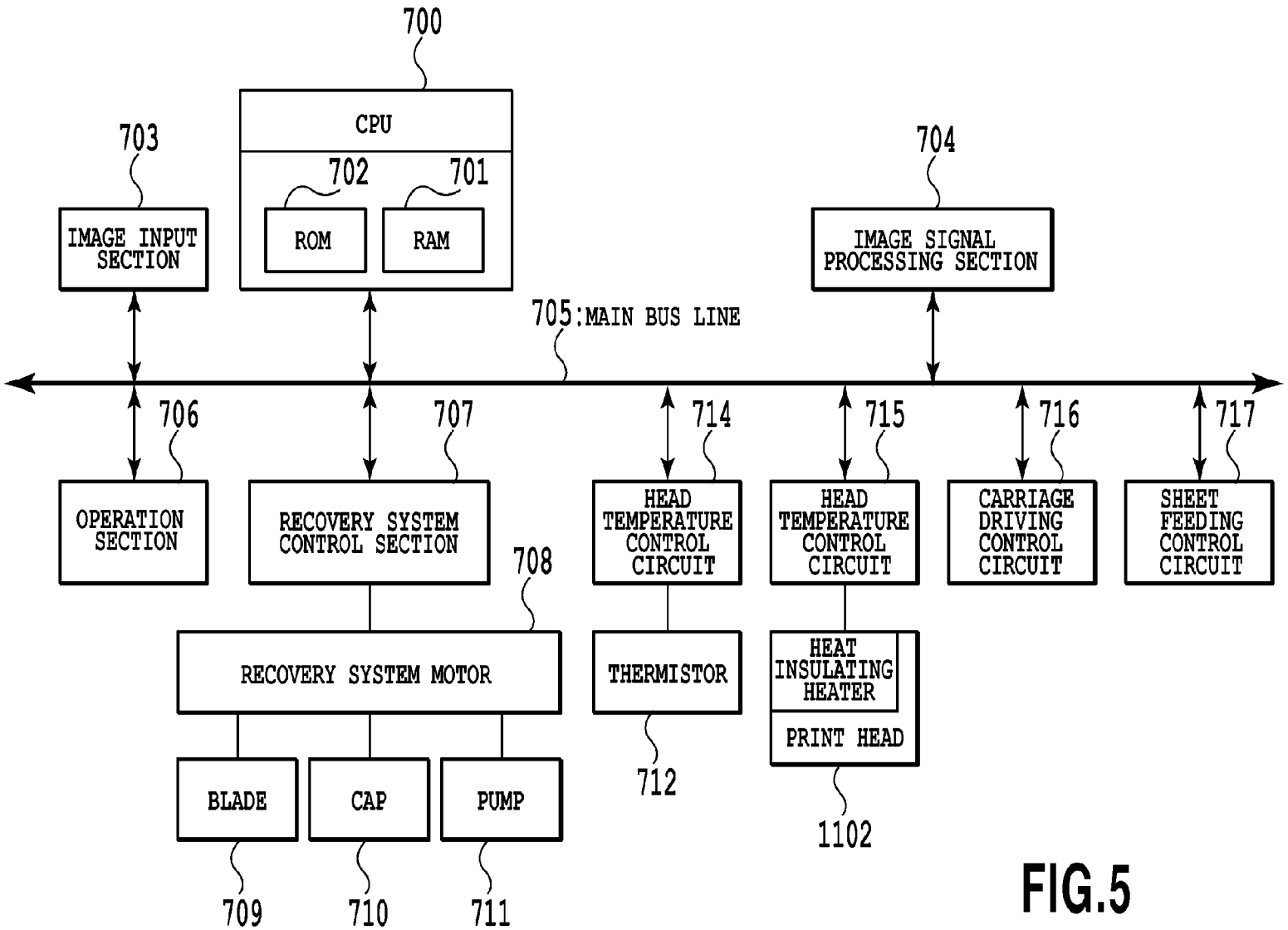
FIG. 5 is a block diagram of the configuration of a control system in the ink jet printing apparatus in FIG. 1.

FIG. 5 is a block diagram of a control system in the ink jet printing apparatus in the present example.

In FIG. 5, a CPU 700 controls appropriate sections described below and processes data. The CPU 700 performs head driving control, carriage driving control, data processing, and the like via a main bus line 705 in accordance with programs stored in a ROM 702. A RAM 701 is used as a work area for the data processing or the like executed by the CPU 700. Besides the ROM 702 and the RAM 701, a memory such as a hard disk is provided for the CPU 700. An image input section 703 has an interface that allows information to be transmitted to and received from a host apparatus (not shown) which is connected to the printing apparatus. The image input section 703 temporarily holds images input by the host apparatus. An image signal processing section 704 executes data processing such as a color converting process or a binarizing process. An operation section 706 comprises keys and the like to enable an operator to perform control, inputting, and the like.

A recovery system control circuit 707 controls a recovery operation in accordance with a recovery process program stored in the RAM 701. That is, the recovery system control circuit 707 drives a recovery system motor 708 to operate a cleaning blade 709, a cap 710, a suction pump 711, and the like. The recovery system control circuit 707 thus executes a recovery process to allow a print head 1102 to maintain a correct ink ejection condition. Operating the cleaning blade 709 makes it possible to wipe a surface of the print head 1102 on which the ejection ports are formed. Operating the cap 710 and the suction pump 711 makes it possible to suck ink not contributing to image printing, into the cap 710 through the ejection ports (suction recovery process).

A head driving control circuit 715 controls driving of the electrothermal converters (heaters) provided in the individual nozzles in the print head 1102. The head driving control circuit 715 further allows the print head 1102 to perform preliminary ejection and ink ejection for printing. The preliminary ejection is a recovery process and allows ink not contributing to image printing to be ejected toward the interior of the cap 710. A carriage driving control circuit 716 and a sheet feeding control circuit 717 control movement of the carriage and sheet feeding in accordance with appropriate programs.

In the print head 1102, a board with the electrothermal converters provided therein has heat insulating heaters that can heat the ink inside the print head to adjust the temperature thereof to a desired set temperature. The board has a thermistor 712 that can measure the substantial temperature of the ink inside the print head. However, the thermistor 712 may be provided outside the board provided that the thermistor 712 is located around the periphery and in the vicinity of the print head.

Figure 6:
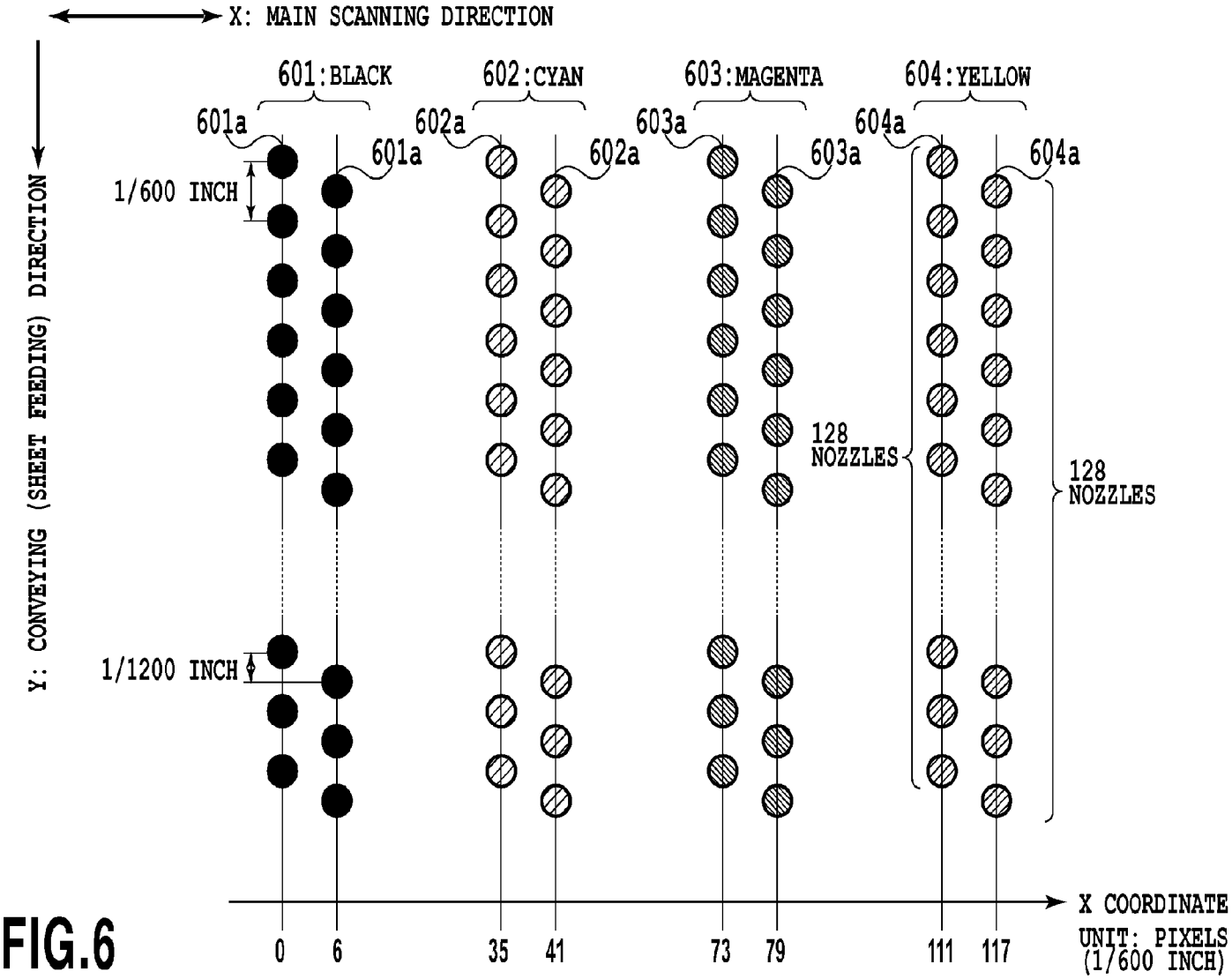
FIG. 6 is a diagram illustrating the arrangement of a plurality of nozzle rows in the print head.

FIG. 6 is a diagram illustrating the arrangement of the ejection ports in the print head 1102 according to the present embodiment. A portion including the ejection port and the electrothermal converter is hereinafter also referred to as the "nozzle".

In FIG. 6, reference numerals 601, 602, 603, and 604 denote nozzle rows for black ink, cyan ink, magenta ink, and yellow ink, respectively. The nozzle rows for the four color inks are formed of even-numbered nozzle rows 601*a*, 602*a*, 603*a*, and 604*a* and odd-numbered nozzle rows 601*b*, 602*b*, 603*b*, and 604*b*, respectively. The arrangement of the ejection ports will be described below in detail talking the black ink nozzle row 601 by way of example.

In each of the even-numbered nozzle row 601*a* and the odd-numbered nozzle row 601*b*, 128 ejection ports are arranged at a pitch of 600 dpi (dots per inch). Each of the ejection ports in the nozzle row 601*a* is displaced from the corresponding one of the ejection ports in the nozzle rows 601*b* by 1,200 dpi in the Y direction (sub-scanning direction). The print head has a length (the length of the nozzle rows) of 5.24 mm (=128/600×2.54 mm). Consequently, by ejecting the ink while performing scan in the X direction (main scanning direction), the print head can print an image of width about 5.24 mm at a resolution of 1,200 dpi in the sub-scanning direction.

The other nozzle rows are configured similarly to the black nozzle row 601 and arranged in parallel in the main scanning direction as shown in FIG. 6.

Figure 7:
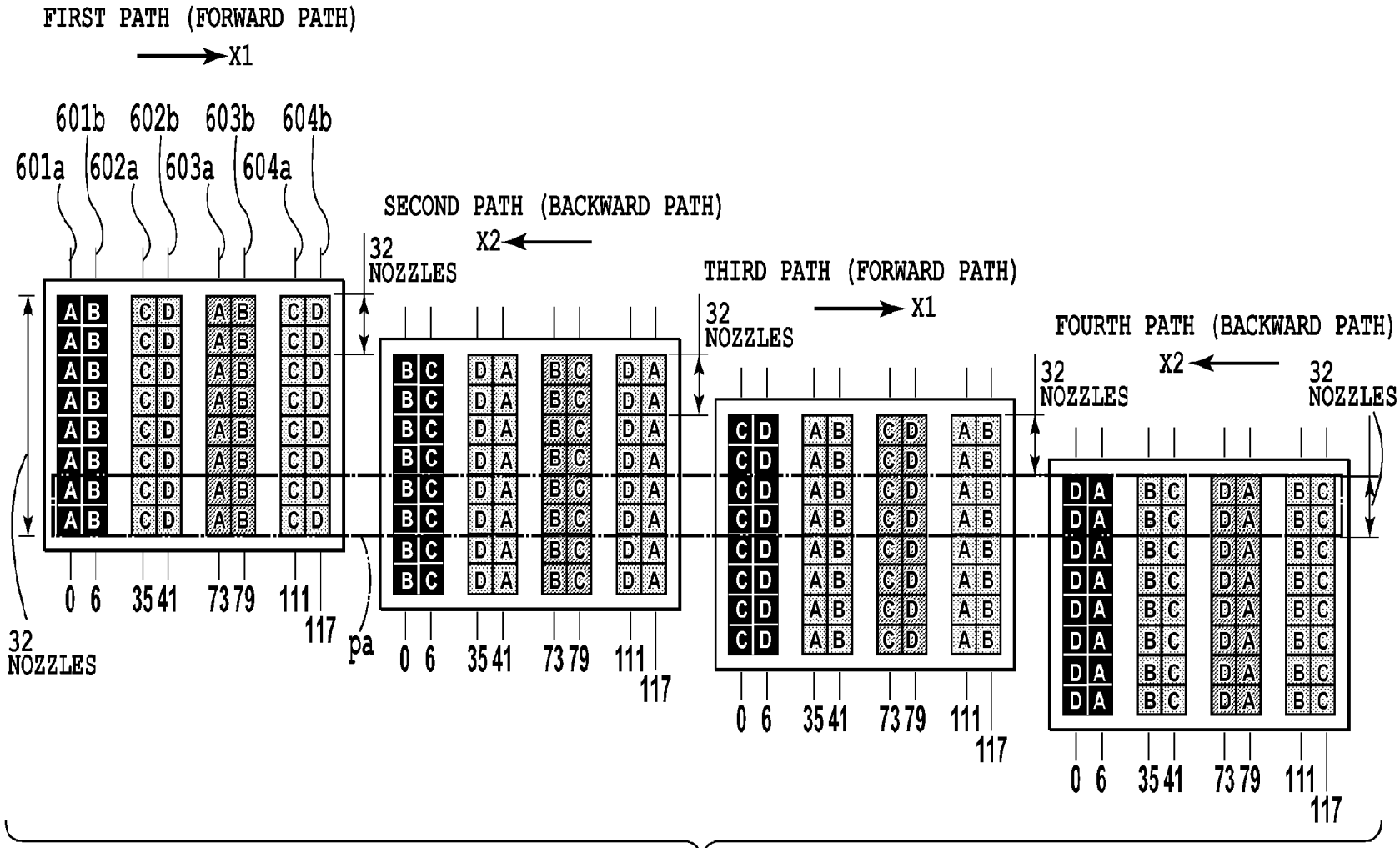
FIG. 7 is a diagram illustrating the relationship between a 4-pass printing method and mask patterns.

FIG. 7 is a schematic diagram illustrating the features of the mask patterns applied in the present embodiment. In this example, a multi-pass printing method with four bidirectional passes is used to complete an image in a predetermined area (unit) by means of four main scans. The first scan is the first pass in the forward direction shown by an arrow X1. The second scan is the second pass in the backward direction shown by an arrow X2. The third scan is the third pass in the forward direction shown by the arrow X1. The fourth scan is the fourth pass in the backward direction shown by the arrow X2. Each of the even-numbered nozzle rows 601*a*, 602*a*, 603*a*, and 604*a*, which is made up of the 128 nozzles, is divided into eight blocks each including 16 nozzles in the sub-scanning direction. For each print scan, each block is associated with one type of mask pattern. Likewise, each of the odd-numbered nozzle rows 601*b*, 602*b*, 603*b*, and 604*b*, which is made up of the 128 nozzles, is divided into eight blocks each including 16 nozzles in the sub-scanning direction. For each print scan, each block is associated with one type of mask pattern. During the interval between the print scans, the print medium is conveyed in the Y direction (sub-scanning direction), by two blocks (32 nozzles). FIG. 7 shows that the print head moves relative to the print medium.

In FIG. 7, reference characters A, B, C, and D denote four different types of mask patterns that are exclusive and complementary to each another. That is, an image in the same area on the print medium P is completed by using each of the four types of mask patterns A to D during a corresponding one of the four print scans. For the same print scan, the mask patterns used for the even- and odd-numbered nozzle rows for each color are set to be different from each other.

Figure 8:
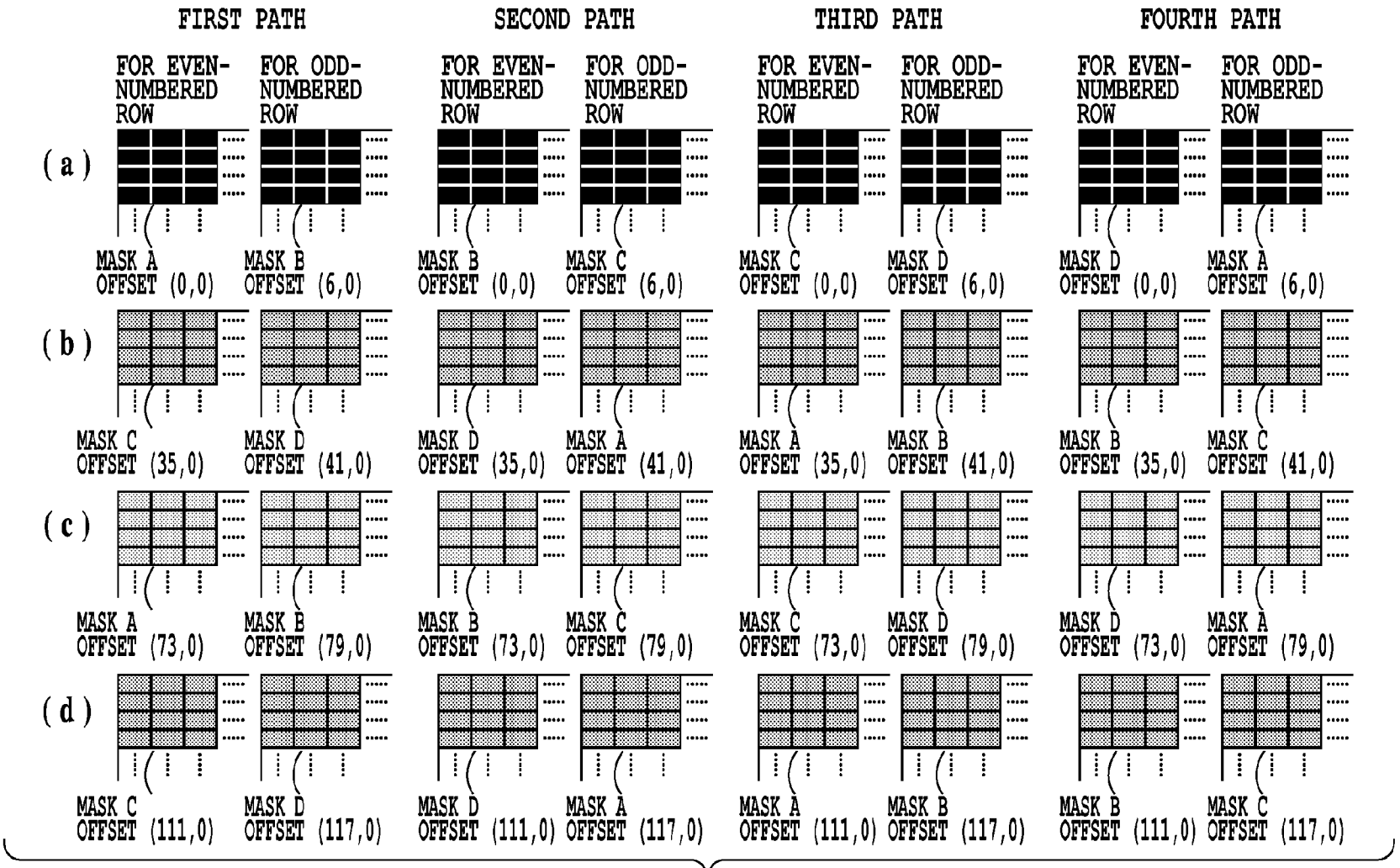
FIG. 8 is a diagram illustrating the mask patterns used for the first embodiment of the present invention, wherein (a) to (d) show the mask patterns used for nozzle rows through which black ink, cyan ink, magenta ink, and yellow ink, respectively, are ejected.

FIG. 8 is a diagram illustrating the mask patterns used for a print completed area Pa for the image in FIG. 7. In FIG. 8, (a) denotes the mask pattern used for the nozzle row through which the black ink is ejected, and (b) denotes the mask pattern used for the nozzle row through which the cyan ink is ejected. In FIG. 8, (c) denotes the mask pattern used for the nozzle row through which the magenta ink is ejected, and (d) denotes the mask pattern used for the nozzle row through which the yellow ink is ejected.

Figure 9:
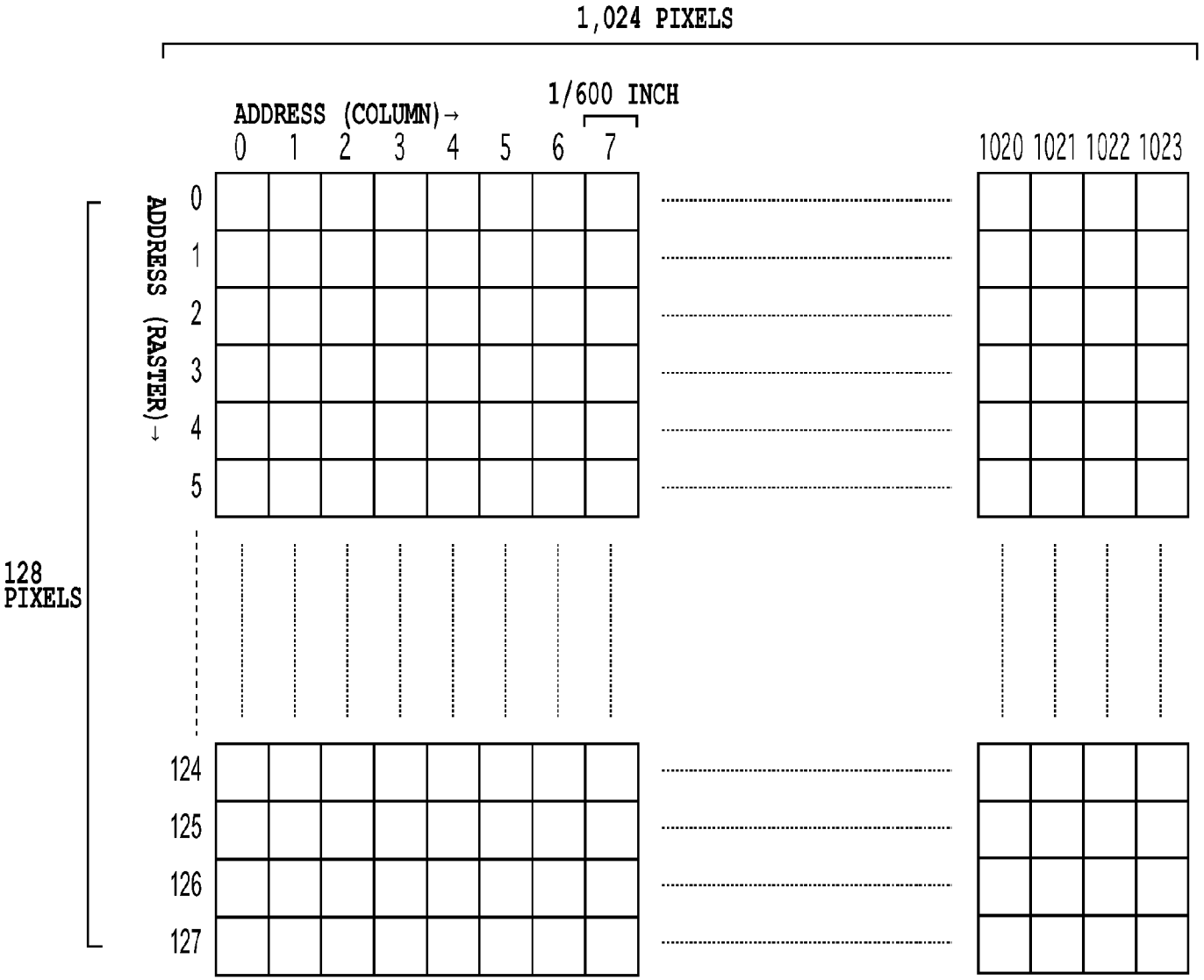
FIG. 9 is a diagram illustrating the size of the mask pattern.

FIG. 9 is a diagram showing the relationship between the mask patterns (A to D) and pixels.

In view of the memory capacity of the storage device, each of the mask patterns has a predetermined size and is repeatedly used in the main scanning direction and in the sub-scanning direction. For the mask pattern in FIG. 9, a pattern with a size of 1,024×128 pixels is repeatedly used.

A timing for starting reading the mask pattern is determined in accordance with a timing for ejecting ink when the nozzle row is positioned above the print area on the print medium. That is, the timing for starting reading the mask pattern is determined on the basis of a timing for expanding ink ejection data corresponding to the nozzle row (herein after also referred to as a "timing for opening a heat window").

Figure 10:
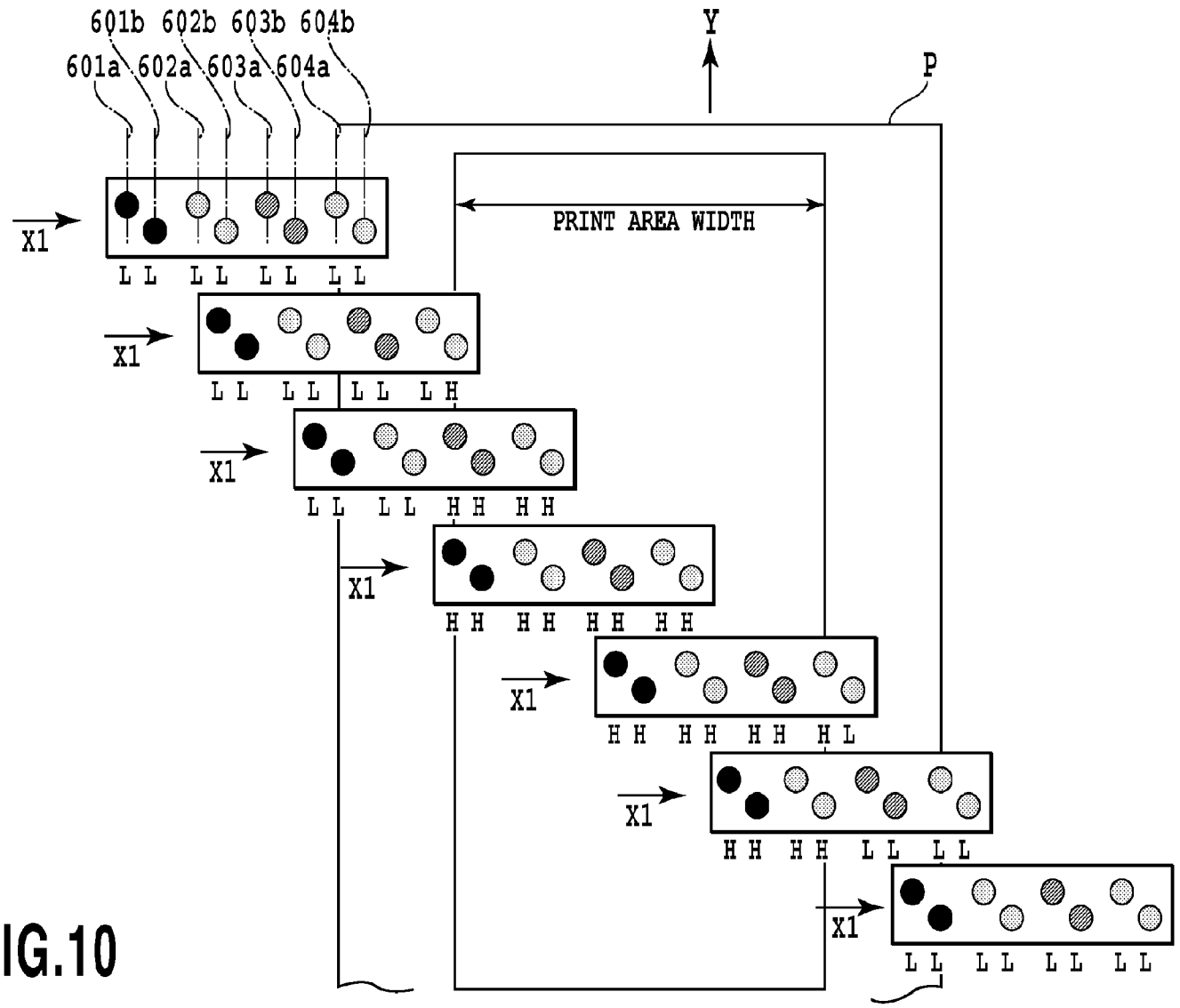
FIG. 10 is a diagram illustrating timings at which a heat window is opened during forward scanning.
Figure 11:
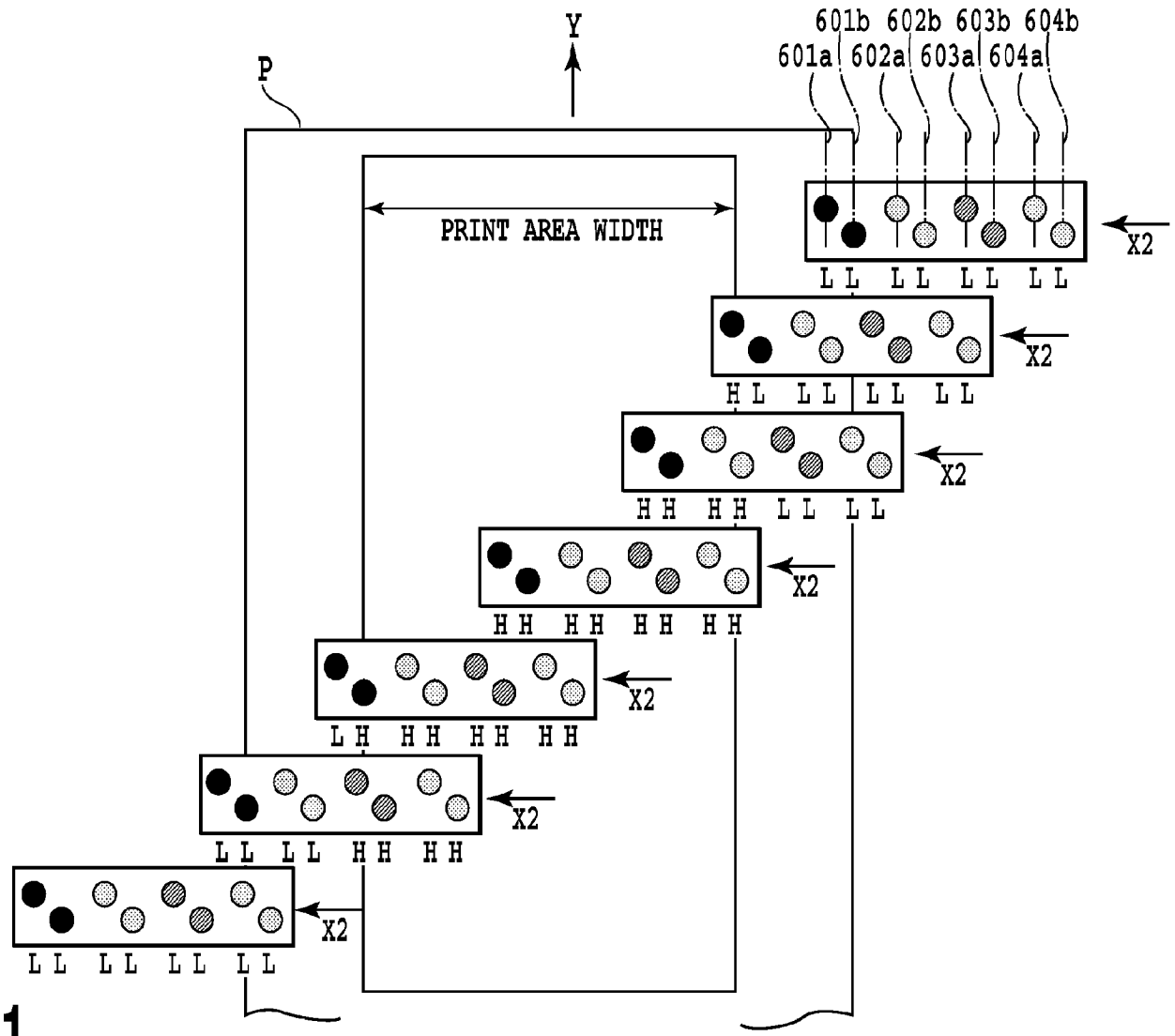
FIG. 11 is a diagram illustrating timings at which a heat window is opened during backward scanning.

FIGS. 10 and 11 are diagrams illustrating the timing for opening the heat window in connection with the actual printing operation.

In FIGS. 10 and 11, L indicates that the heat window is closed, and H indicates that the heat window is open. For a forward scan in which the print head moves in the direction of the arrow X1 as shown in FIG. 10, the heat window is first opened for the yellow ink ejecting odd-numbered nozzle row 604*a*, located closest to the print area in the print medium P. Subsequently, the heat window is opened in order of the nozzle rows 604*a*, 603*b*, 603*a*, 602*b*, 602*a*, 601*b*, and 601*a*. On the other hand, for a backward scan in which the print head moves in the direction of the arrow X2 as shown in FIG. 11, the heat window is opened in the order opposite to that for the forward scan. Thus, the timing for opening the heat window varies with the nozzle row depending on the position of the nozzle row and the scanning direction. That is, the ink ejection timing (driving condition) varies depending on the physical displacement of each nozzle row in the main scanning direction.

In the present embodiment, reading of the mask pattern is started from a read start address described below in synchronism with the opening of the heat window described above.

As shown in FIG. 6, the print head in the present example is in what is called a horizontal arrangement form in which a plurality of nozzle rows are arranged in parallel. In the present example, the black ink ejecting even-numbered nozzle row 601*a* is set to be a reference position in the main scanning direction. The nozzle rows 601*b*, 602*a*, 602*b*, 603*a*, 603*b*, 604*a*, and 604*b* are displaced from the reference position by 6, 35, 41, 73, 79, 111, and 117 pixels, respectively, in the main scanning direction.

In the present embodiment, in view of the physical positional displacement of the nozzle rows in the main scanning direction, the mask patterns A to D are offset in the raster direction (the direction in which columns are arranged) corresponding to the main scanning direction. Specifically, the read start addresses of the mask patterns are displaced in the raster direction as shown in (a), (b), (c), and 8 of FIG. 8.

That is, for the mask pattern assigned to the black-ink-ejecting even-numbered nozzle row 601*a*, a horizontal (raster direction) displacement amount is set to "0". More specifically, the mask pattern is read from a read start address (0,0) as shown in (a) of FIG. 8. The mask pattern assigned to the black-ink-ejecting odd-numbered nozzle row 601*b* is offset in the horizontal direction by six pixels, corresponding to the amount of displacement of the nozzle row 601*b* in the main scanning direction. That is, the mask pattern is read from a read start address (6,0) as shown in (a) of FIG. 8.

Similarly, the mask patterns assigned to the cyan ink ejecting nozzle rows 602*a* and 602*b* are offset in the horizontal direction by 35 and 41 pixels, respectively, corresponding to the amounts of the displacement of the nozzle rows 602*a* and 602*b* in the main scanning direction. That is, the mask patterns are read from read start addresses (35,0) and (41,0), respectively, as shown in (b) of FIG. 8. The mask patterns assigned to the magenta ink ejecting nozzle rows 603*a* and 603*b* are offset in the horizontal direction by 73 and 79 pixels, respectively, corresponding to the amounts of the displacement of the nozzle rows 603*a* and 603*b* in the main scanning direction. That is, the mask patterns are read from read start addresses (73,0) and (79,0), respectively, as shown in (c) of FIG. 8. The mask patterns assigned to the yellow ink ejecting nozzle rows 604*a* and 604*b* are offset in the horizontal direction by 111 and 117 pixels, respectively, corresponding to the amounts of the displacement of the nozzle rows 604*a* and 604*b* in the main scanning direction. That is, the mask patterns are read from read start addresses (111,0) and (117,0), respectively, as shown in (d) of FIG. 8.

In the present embodiment, the mask patterns are offset according to the physical positional displacement of the nozzle rows in the main scanning direction, that is, according to the variation in timing for opening the heat window (timing for starting the reading of the mask pattern). The offset mask patterns are used to divide the print data.

Figure 12:
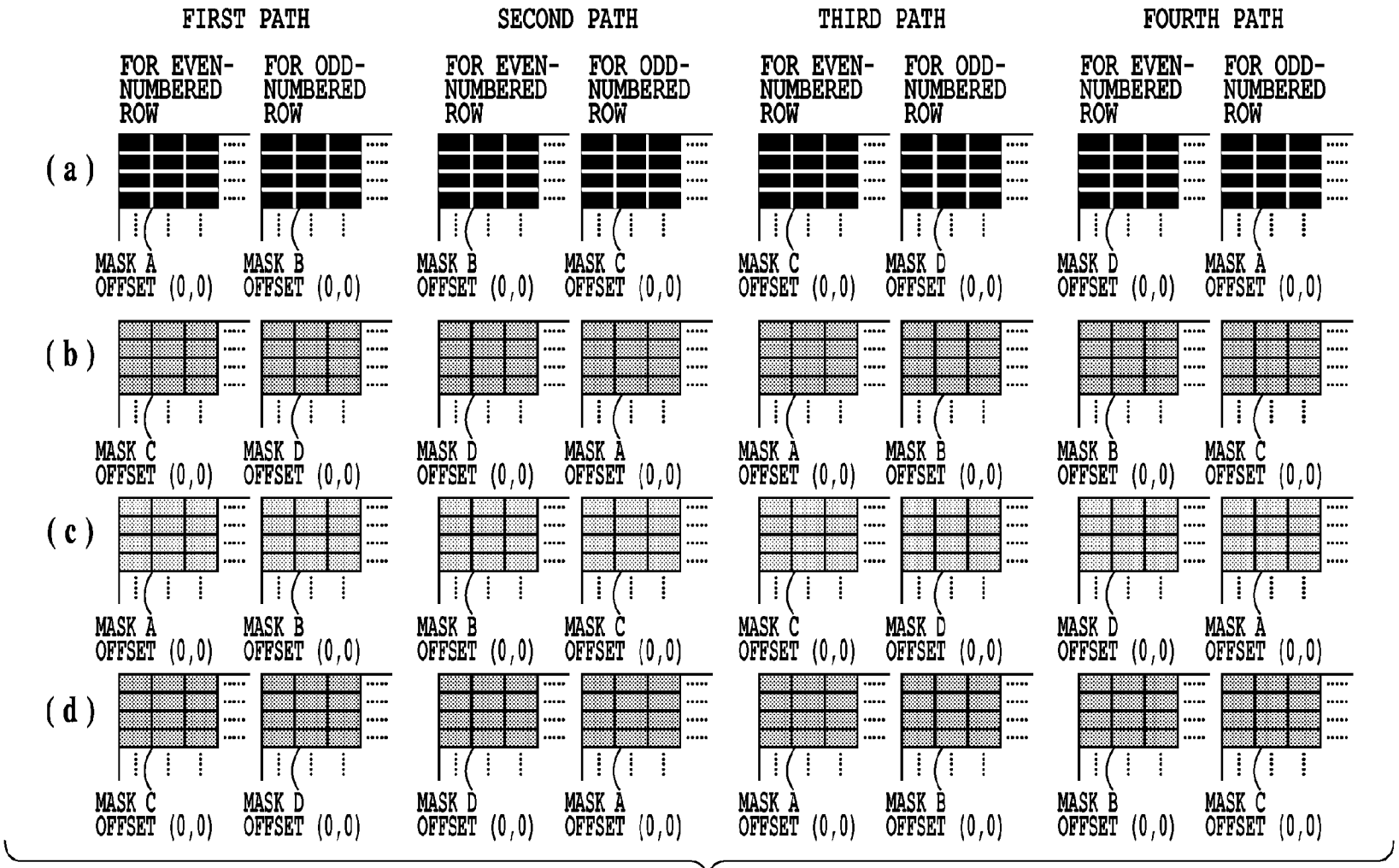
FIG. 12 is a diagram illustrating the mask patterns used for the conventional 4-pass printing method, wherein (a) to (d) show the mask patterns used for nozzle rows through which black ink, cyan ink, magenta ink, and yellow ink, respectively, are ejected.

In the conventional art, the print data is divided using the mask pattern read from the specified read start address (0,0) regardless of the read start timings for the mask patterns as shown in (a), (b), (c), and (d) of FIG. 12. That is, the print data is divided using the mask pattern read from the specified read start address (0,0) regardless of the physical positional displacements among the nozzle rows and the variation of an ink ejecting timing caused by differences in ink ejection characteristics among the nozzle rows. Consequently, the mask patterns A to D are assigned directly to the corresponding nozzle rows without being offset in the raster direction corresponding to the main scanning direction or in the column direction corresponding to the sub-scanning direction.

In the present embodiment, the exclusively complementary mask patterns are offset according to the positional displacement of the nozzle rows in the main scanning direction. Thus, as described below, the mask patterns maintain the exclusively complementary relationship at any timings. As a result, if a plurality of nozzle rows are each divided into the same number of blocks for block driving, the nozzles in the plurality of nozzle rows which belong to the same driving block are prevented from being simultaneously driven. On the other hand, if the mask patterns are not offset as in the conventional art, the mask patterns may fail to maintain the exclusively complementary relationship at a certain timing. As a result, if the plurality of nozzle rows are each divided into the same number of blocks for block driving, the nozzles in the plurality of nozzle rows which belong to the same driving block may be simultaneously driven.

Now, with reference to FIGS. 13 to 19, description will be given of the offsets of the mask patterns, the mutual relationship among the mask patterns, and block driving.

Figure 13:
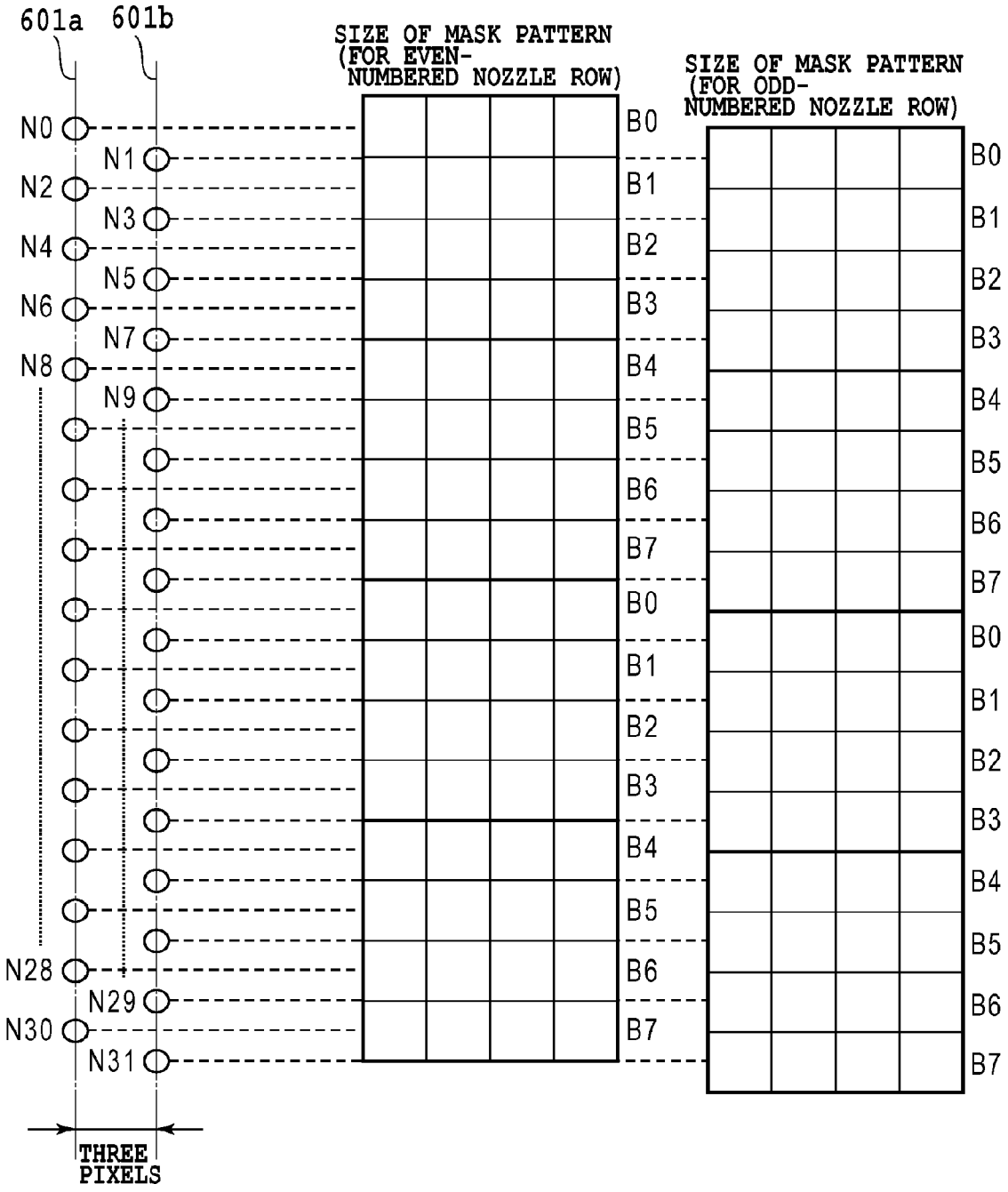
FIG. 13 is a diagram illustrating the relationship between the nozzle rows and the mask patterns.
Figure 14A:
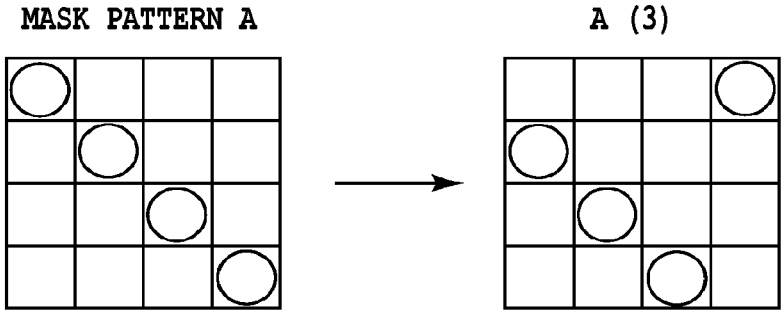
FIGS. 14A to 14D are diagrams illustrating the conditions of the mask patterns A to D before and after offset.
Figure 14B:
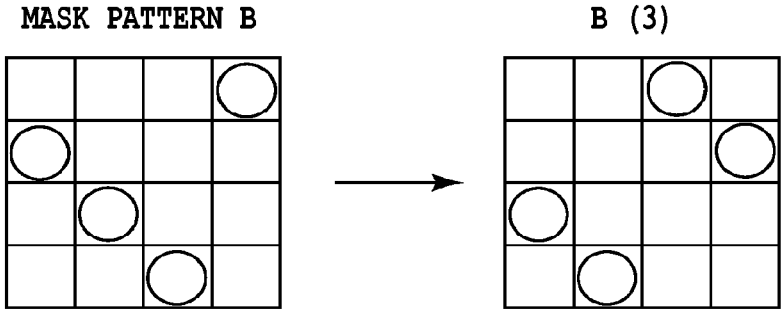
Figure 14C:
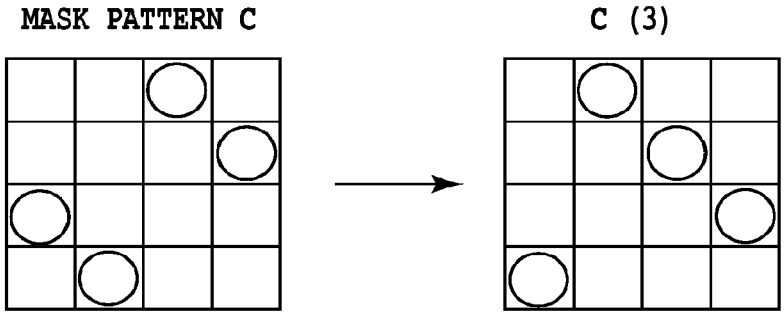
Figure 14D:
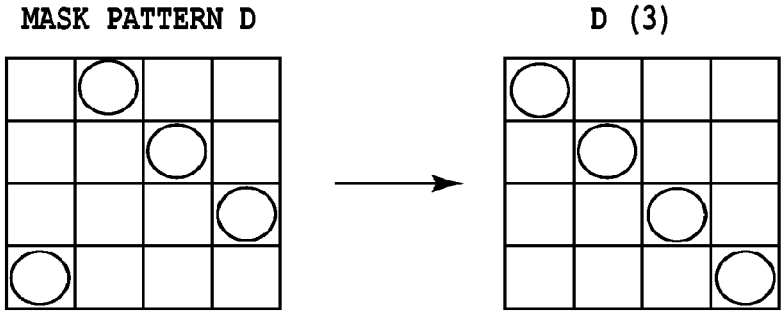

In the example described below, for convenience of description, focus is placed on the even-numbered nozzle row 601*a* and the odd-numbered nozzle row 601*b* through which the black ink is ejected. It is assumed that 16 nozzles are formed in each of the nozzle rows 601*a* and 601*b* as shown in FIG. 13. In FIG. 13, N0, N2, N4, . . . N30 are numbers (nozzle numbers) assigned to the 16 nozzles forming the nozzle row 601*a*. N1, N3, N5, . . . N31 are numbers (nozzle numbers) assigned to the 16 nozzles forming the nozzle row 601*b*. Here, the nozzle row 601*b* is displaced from the nozzle row 601*a* as a reference by three pixels in the main scanning direction. The mask patterns used to divide the print data into pieces in association with the nozzle rows 601*a* and 601*b* are each 4×4 in size. The nozzles forming the nozzle row 601*a* are divided into eight blocks, blocks B0 to B7, for block driving as shown in FIG. 13. Likewise, the nozzles forming the nozzle row 601*b* are divided into eight blocks, blocks B0 to B7, for block driving.

Figure 15:
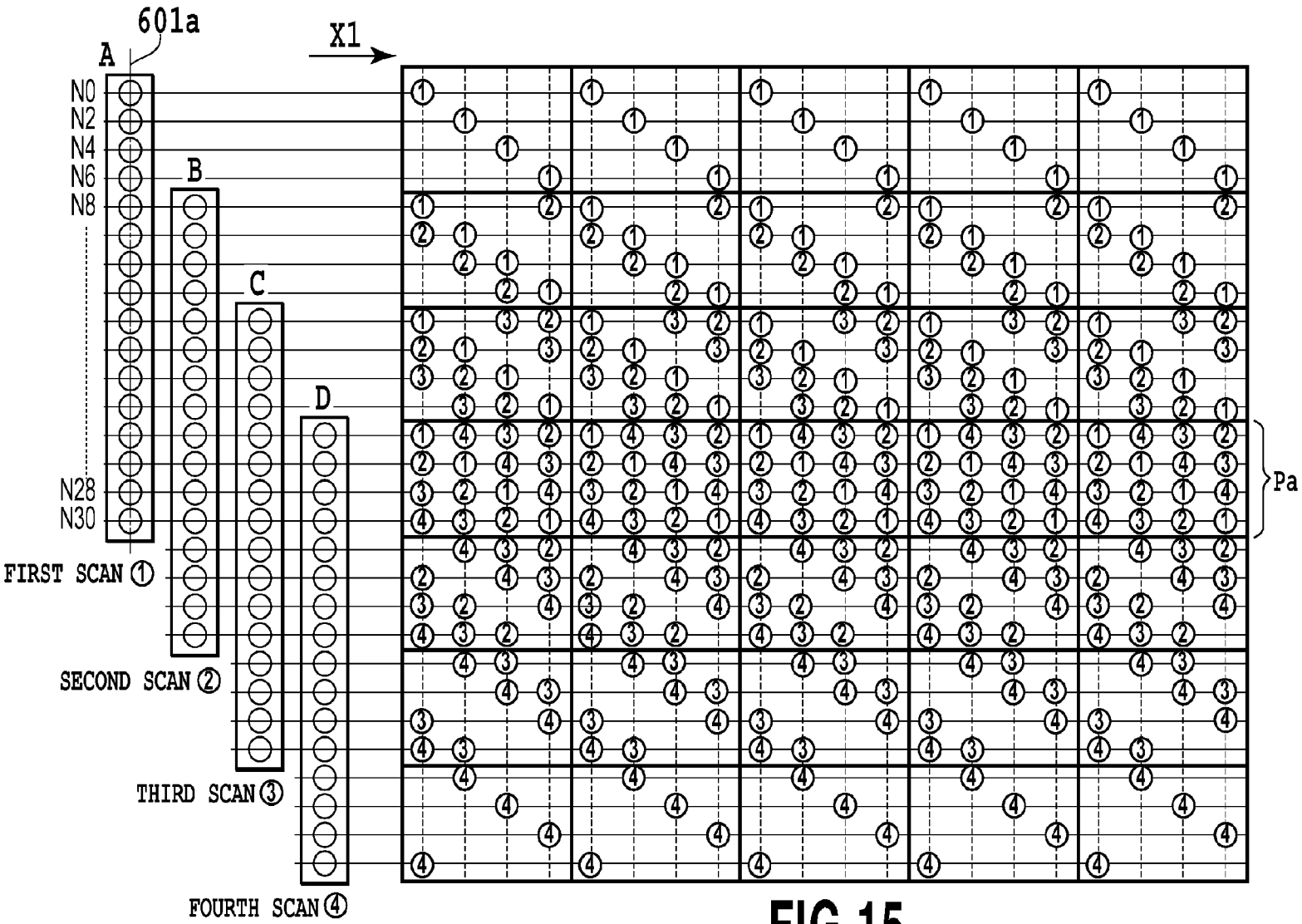
FIG. 15 is a diagram illustrating how an even-numbered nozzle row is driven according to the conventional 4-pass printing method.
Figure 16:
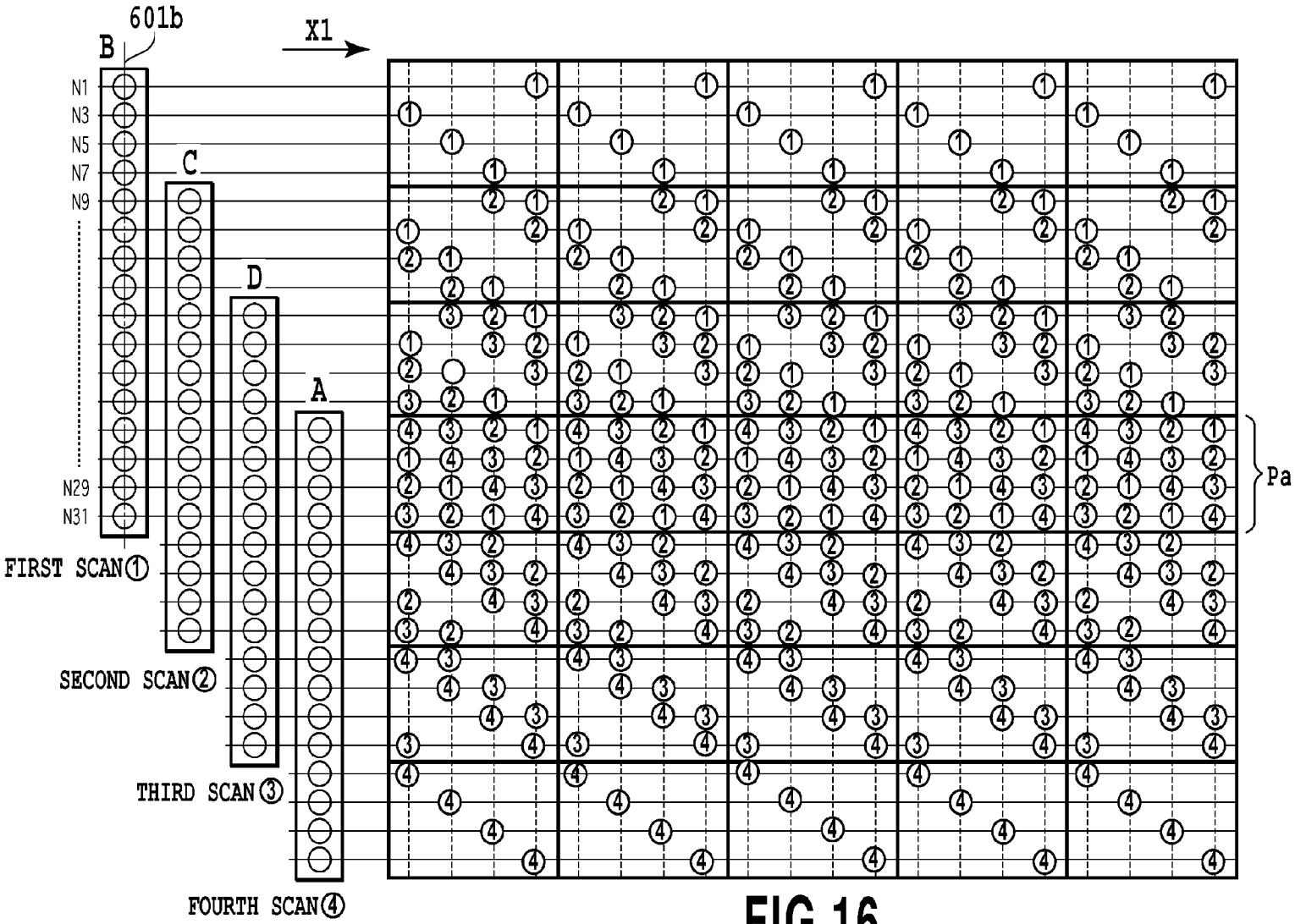
FIG. 16 is a diagram illustrating how an odd-numbered nozzle row is driven according to the conventional 4-pass printing method.

In the present example, the nozzle rows 601*a* and 601*b* are used to print images according to a 4-unidirectional-pass printing method. That is, as shown in FIGS. 15 and 16, to complete an image in the area Pa on the print medium, a print scan is repeated four times in which ink is ejected through the nozzle rows 601*a* and 601*b* being moved in the direction of the arrow X1. During the interval between the print scans, the print medium is conveyed in the sub-scanning direction by a distance equal to four nozzles.

Figure 17:
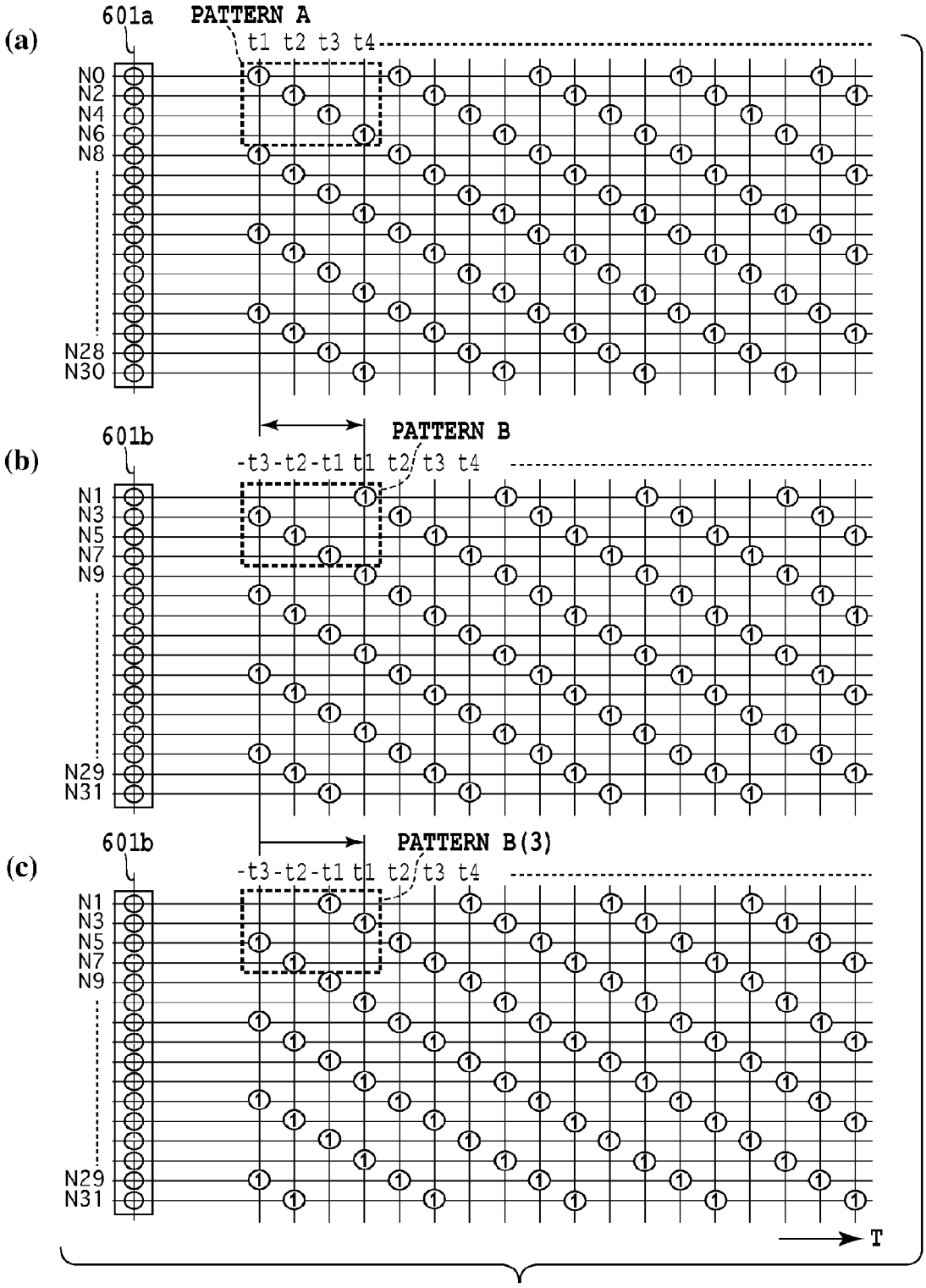
FIG. 17 is a diagram illustrating how the nozzle rows are driven, wherein (a) is a diagram illustrating how the even-numbered nozzle row is driven during the first scan, (b) is a diagram illustrating how the odd-numbered nozzle row is driven during the first scan according to the conventional art, and (c) is a diagram illustrating how the odd-numbered nozzle row is driven during the first scan according to the first embodiment of the present invention.
Figure 18:
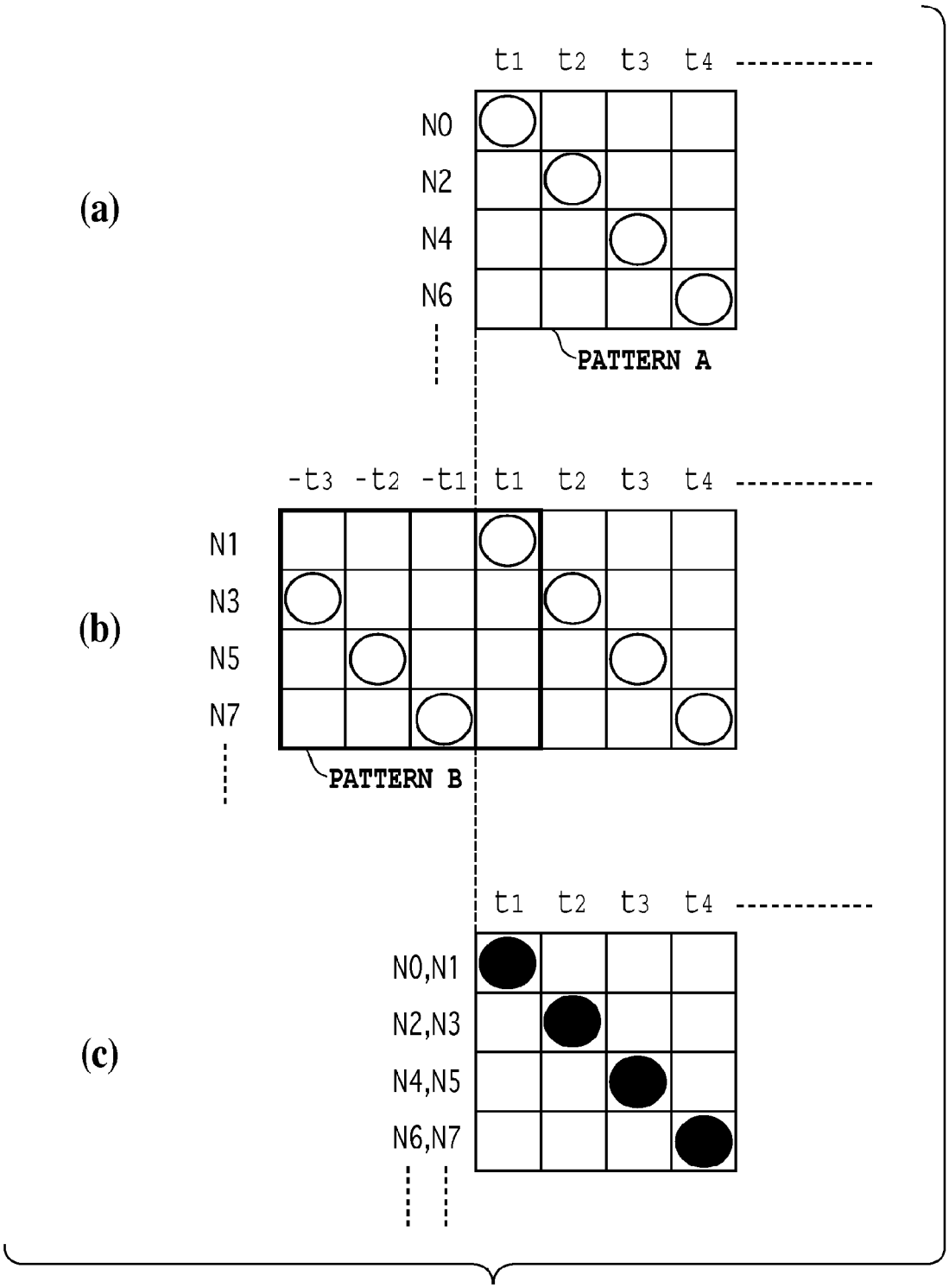
FIG. 18 is a diagram illustrating a driving form according to the conventional 4-pass printing method, wherein (a) shows a pattern used for the even-numbered row during the first scan, (b) shows a pattern used for the odd-numbered row during the first scan, and (c) shows the presence or absence of nozzles that are simultaneously driven during the first scan.

FIG. 15, FIG. 16, parts (a) and (b) of FIG. 17, and FIG. 18 are diagrams illustrating an example of printing performed when the mask patterns are not offset as is the case with the conventional art.

In FIG. 15, the exclusively complementary mask patterns A, B, C, and D are sequentially used to divide the print data in association with the nozzle row 601*a* as shown in FIGS. 14A to 14D. Similarly, in FIG. 16, the exclusively complementary mask patterns A, B, C, and D are sequentially used to divide the print data in association with the nozzle row 601*b* as shown in FIGS. 14A to 14D. During the same print scan, different mask patterns are used for the respective nozzle rows 601*a* and 601*b*. That is, during the first scan, the mask patterns A and B are used for the nozzle rows 601*a* and 601*b*. During the second scan, the mask patterns B and C are used for the nozzle rows 601*a* and 601*b*. During the third scan, the mask patterns C and D are used for the nozzle rows 601*a* and 601*b*. During the fourth scan, the mask patterns D and A are used for the nozzle rows 601*a* and 601*b*.

Parts (a) and (b) of FIG. 17 are diagrams of the relationship between driving timings for the nozzle rows 601*a* and 601*b* during the first print scan.

The nozzle row 601*a* starts to be driven at a point in time t1 on the basis of print data thinned out by using the mask pattern A. On the other hand, since the nozzle row 601*b* is displaced from the nozzle row 601*a* in the X1 direction by three pixels, the timing for opening the heat window for the nozzle row 601*b* is earlier than the point in time t1 by an amount of time corresponding to three pixels. Consequently, the nozzle row 601*b* starts to be driven at a point in time (−t3) on the basis of print data thinned out by using the mask pattern B. That is, the mask pattern B is not offset but only the read start timing differs from that for the mask pattern A according to the positional displacement of the nozzle row 601*b*.

As a result, for example, at the point in time t1, the nozzle N0 belonging to the block B0 of the nozzle row 601*a* and the nozzle N1 belonging to the block B0 of the nozzle row 601*b* are simultaneously driven. This is because at the point in time t1, the exclusively complementary relationship is not maintained between the mask patterns A and B. At a point in time t2, the nozzle N2 belonging to the block B1 of the nozzle row 601*a* and the nozzle N3 belonging to the block B1 of the nozzle row 601*b* are simultaneously driven. This is also because at the point in time t2, the exclusively complementary relationship is not maintained between the mask patterns A and B. In parts (a) and (b) of FIG. 17, the exclusively complementary relationship fails to be maintained between the mask patterns A and B at all the points in time t1, t2, t3, . . . . The nozzles in the nozzle rows 601*a* and 601*b* which belong to the same driving block are thus simultaneously driven. Accordingly, the number of nozzles to be simultaneously driven cannot be sufficiently reduced. The driving voltage may thus vary to make it difficult to stably eject the ink. It may also be difficult to reduce the number of nozzles (heaters) to be simultaneously driven to maintain a short driving pulse width. At which of the points in time t1, t2, t3, . . . the exclusively complementary relationship fails to be maintained between the mask patterns A and B varies depending on the positional displacement amount of the nozzle row 601*b*.

Parts (a), (b), and (c) of FIG. 18 are diagrams illustrating the relationship between the mask patterns A and B shown in (a) and (b) of FIG. 17. Part (c) of FIG. 18 shows the logical product (AND) of the driven nozzles in the nozzle row 601*a* (part (a) of FIG. 17) and the driven nozzles in the nozzle row 601*b* (part (b) of FIG. 17). As is apparent from (c) of FIG. 18, at the point in time t1, the nozzles N0 and N1 in the same driving block B0 are simultaneously driven. At the point in time t2, the nozzles N2 and N3 in the same driving block B1 are simultaneously driven. At the point in time t3, the nozzles N4 and N5 in the same driving block B2 are simultaneously driven. At the point in time t4, the nozzles N6 and N7 in the same driving block B3 are simultaneously driven.

Thus, if the mask pattern B is not offset, the exclusively complementary relationship may fail to be maintained between the mask patterns A and B, making it impossible to make full use of the advantages of the block driving method. This also applies to the case in which non-offset mask patterns C, D, and A are used during the second, third, and fourth print scans.

In FIGS. 14A to 14D, mask patterns A(3), B(3), C(3), and D(3) are obtained by offsetting each of the mask patterns A, B, C, and D by an amount equal to the positional displacement (three pixels) of the nozzle row 601*b*. That is, the mask patterns A(3), B(3), C(3), and D(3) are obtained by shifting the read start position of each of the mask patterns A, B, C, and D by three pixels.

Figure 19:
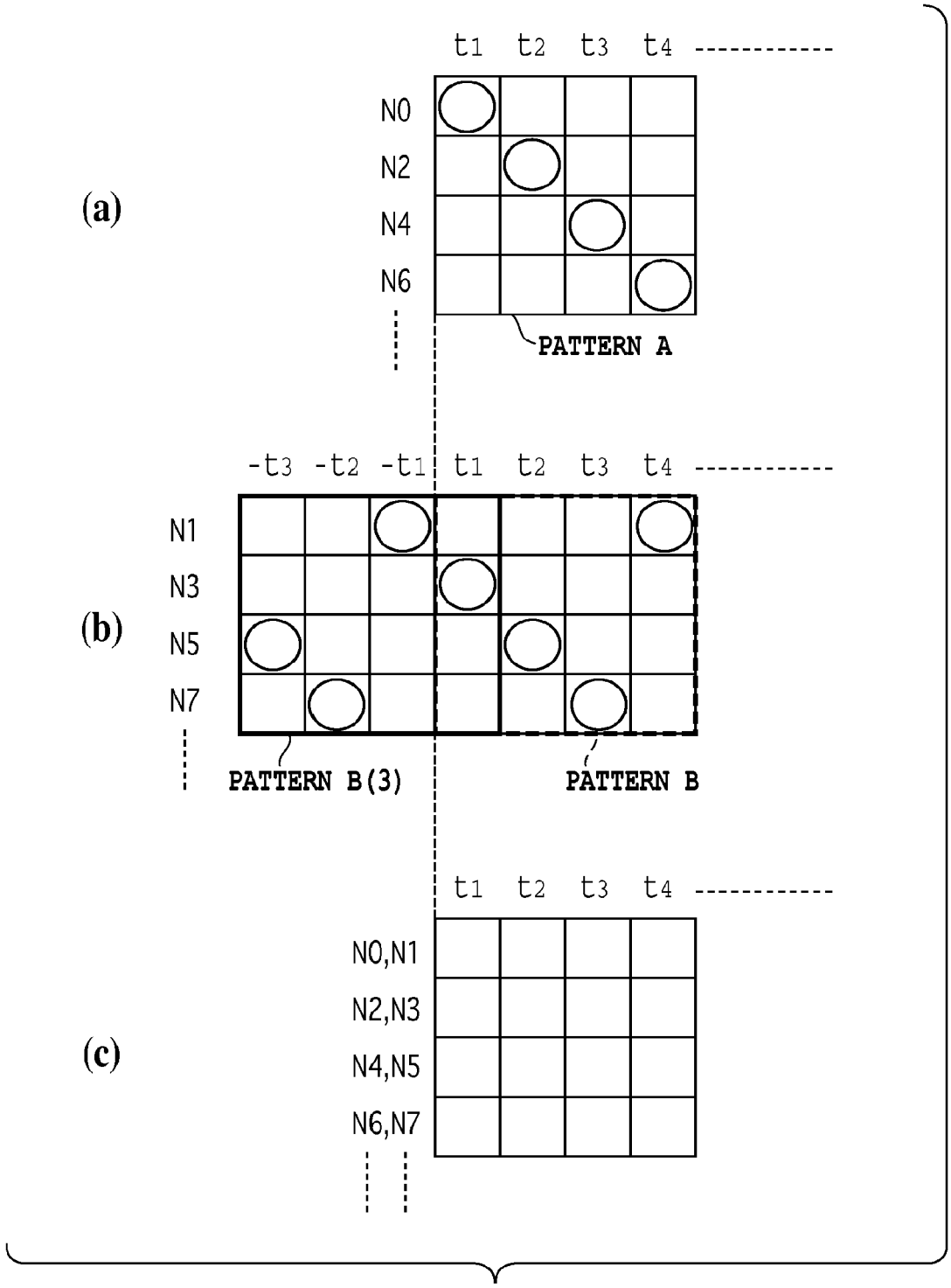
FIG. 19 is a diagram illustrating a driving form according to the 4-pass printing method according to the first embodiment of the present invention, wherein (a) shows a pattern used for the even-numbered row during the first scan, (b) shows a pattern used for the odd-numbered row during the first scan, and (c) shows the presence or absence of nozzles that are simultaneously driven during the first scan.

Parts (a) and (b) of FIG. 17, and FIG. 19 are diagrams illustrating an embodiment of the present invention. The mask patterns offset as shown in the figures are used to drive the nozzle rows. In the present example, during the first scan, the mask patterns A and B(3) are used for the nozzle rows 601*a* and 601*b*, respectively. During the second scan, the mask patterns B and C (3) are used for the nozzle rows 601*a* and 601*b*, respectively. During the third scan, the mask patterns C and D(3) are used for the nozzle rows 601*a* and 601*b*, respectively. During the fourth scan, the mask patterns D and A(3) are used for the nozzle rows 601*a* and 601*b*, respectively.

Part (c) of FIG. 17 is a diagram illustrating that during the first print scan, the mask pattern B(3) is used to drive the nozzle row 601*b*. The nozzle row 601*b* starts to be driven at a point in time (−t3) on the basis of print data shinned off by using the mask pattern B(3). In parts (a) and 17(*c*) of FIG. 17, the exclusively complementary relationship is maintained between the mask patterns A and B (3) at all the points in time t1, t2, t3, . . . . Therefore, the nozzles in the nozzle row 601*a* which belong to a certain driving block are not driven simultaneously with the nozzles in the nozzle row 601*b* which belong to the same driving block.

Parts (a), 19(*b*), and 19(*c*) of FIG. 19 are diagrams illustrating the relationship between the mask patterns A and B(3) shown in parts (a) and 17(*c*) of FIG. 17. Part (c) of FIG. 19 shows the logical product (AND) of the driven nozzles in the nozzle row 601*a* (part (a) of FIG. 17) and the driven nozzles in the nozzle row 601*b* (part (c) of FIG. 17). As is apparent from part (c) of FIG. 19, the nozzles in the nozzle rows 601*a* and 601*b* which belong to the same driving block are prevented from being simultaneously driven at all of the points in time t1, t2, t3, t4, . . . . That is, at the points in time t1, t2, t3, t4, . . . , the mask pattern A in part (a) of FIG. 19 is associated with the mask pattern B (enclosed by a dotted line) in part (b) of FIG. 19, which is exclusively complementary to the mask pattern A.

Thus, the use of the offset mask pattern B(3) maintains the exclusively complementary relationship between the mask patterns A and B(3). Consequently, the nozzles in the nozzle row 601*a* which belong to a certain driving block are not driven simultaneously with the nozzles in the nozzle row 601*b* which belong to the same driving block. This also applies to the cases in which the mask patterns C(3), D(3), and A(3) are used during the second, third, and fourth print scans, respectively. Thus, the number of nozzles to be simultaneously driven can be reduced to inhibit a possible variation in driving voltage to allow the ink to be stably ejected. Furthermore, the number of nozzles (heaters) to be simultaneously driven can be reduced to maintain a short driving pulse width.

In the present embodiment, the mask patterns are offset according to the positional relationship among the nozzle rows in the main scan direction. However, differences in ink ejection characteristics among the nozzle rows may misalign positions where dots are formed on the print medium by ink droplets ejected through the respective nozzle rows. Thus, the offset amount of the mask patterns is preferably determined on the basis of the adjustment amount of the ink ejection timing taking the positional displacement of the dots into account. That is, if a driving condition for the nozzle rows varies depending on at least one of the positional relationship among the nozzle rows in the main scanning direction and the ink ejection characteristics of the nozzle rows, the offset amounts of the mask patterns can be determined according to the driving condition.

Second Embodiment

FIGS. 20 to 28 are diagrams illustrating a second embodiment of the present invention.

To increase print resolution, a print head in the present example has not only the nozzle rows for the respective ink colors in the print head according to the above-described embodiment in FIG. 6 but also nozzle rows arranged in a staggered pattern providing a smaller ink ejection amount.

Figure 20:
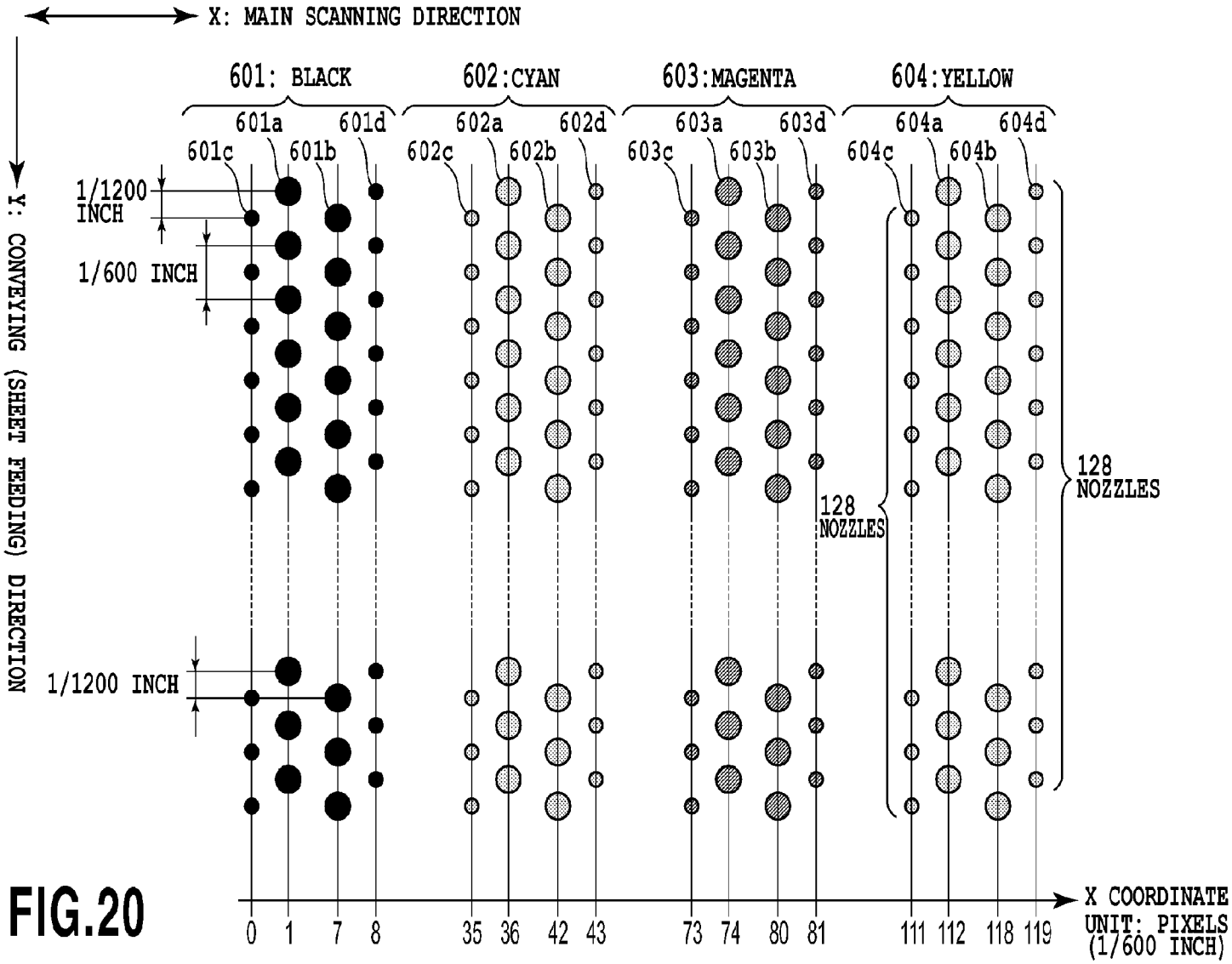
FIG. 20 is a diagram illustrating the arrangement of nozzle rows in a print head used according to a second embodiment of the present invention.
Figure 21:
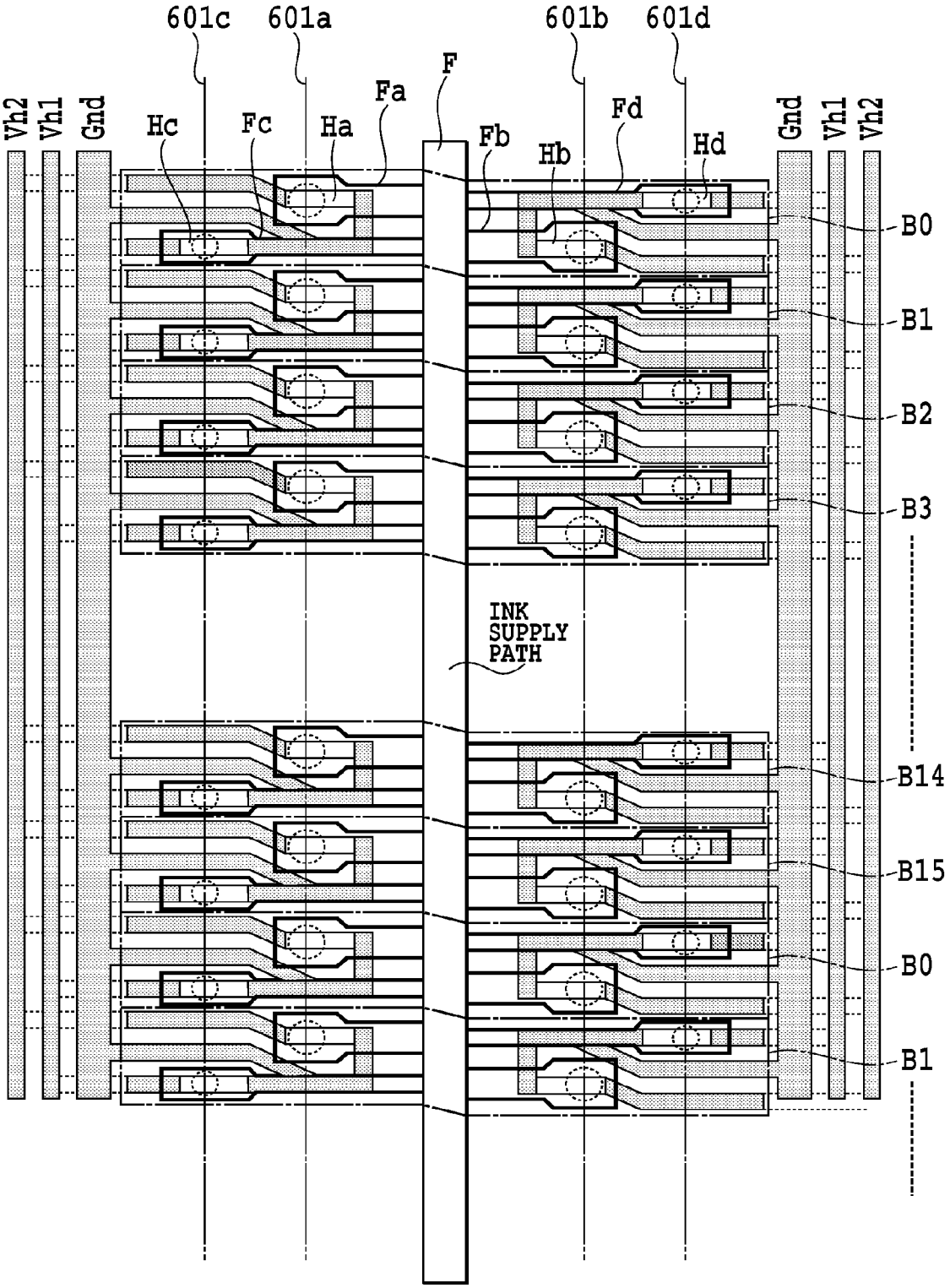
FIG. 21 is a diagram illustrating the arrangement of a black ink ejecting nozzle row shown in FIG. 20.

As shown in FIG. 20, nozzle rows 601*c* and 601*d* are added to the black ink ejecting nozzle rows 601*a* and 601*b*. As shown in FIG. 21, the ejection ports in the inner even-numbered nozzle row 601*a* and odd-numbered nozzle row 601*b*, arranged closer to a common ink supply path F, are in communication with the ink supply path F through channels Fa and Fb. The ejection ports in the outer odd-numbered nozzle row 601*c* and even-numbered nozzle row 601*d*, arranged further from the ink supply path F, are in communication with the ink supply path F through channels Fc and Fd. The ejection ports in the nozzle rows 601*c* and 601*d* are arranged at a pitch of 600 dpi in the sub-scanning direction and staggered. The outer nozzle rows 601*c* and 601*d* are arranged further from the ink supply path F and thus exhibit ink refill characteristics inferior to those of the inner nozzle rows 601*a* and 601*b*. Thus, in the present example, the outer nozzle rows 601*c* and 601*d* have a smaller ink ejection amount than the inner nozzle rows 601*a* and 610*b*. This enables ink droplets of different sizes to be ejected. In the description below, the inner nozzle rows 601*a* and 601*b* are also referred to as "large nozzle rows". The outer nozzle rows 601*c* and 601*d* are also referred to as "small nozzle rows".

Furthermore, as shown in FIG. 21, the same power supply wire is used for heaters Ha corresponding to the ejection ports in the inner nozzle row 601*a* and for heaters Hc corresponding to the ejection ports in the outer nozzle row 601*c*. That is, the same ground line (Gnd) is connected to the heaters Ha and to the heaters Hc, and individual power supply lines (Vh1 and Vh2) are connected to the heaters Ha and Hc. Similarly, the same power supply wire is used for heaters Hb corresponding to the ejection ports in the outer nozzle row 601*b* and for heaters Hd corresponding to the ejection ports in the outer nozzle row 601*d*. That is, the same ground line (Gnd) is connected to the heaters Hb and to the heaters Hd, and individual power supply lines (Vh1 and Vh2) are connected to the heaters Hb and Hd.

All of the nozzle rows 601*a*, 601*b*, 601*c*, and 601*d* use a time division driving method dividing the nozzle row into 16 driving blocks 0 to 15 as shown in FIG. 21. The nozzles in each of the nozzle rows are heated (driven) such that the respective driving blocks are driven at different timings in accordance with a 4-bit block signal attached to heat data. The order in which the 16 driving blocks are driven is the same for all of the nozzle rows 601*a*, 601*b*, 601*c*, and 601*d*. Thus, the same decoder circuit can be used for print data corresponding to the respective nozzle rows. Accordingly, at the same time division timing, the nozzles in a certain driving block of the inner block nozzle row 601*a* can be driven simultaneously with the nozzles in the same driving block of the outer block nozzle row 601*c*. Similarly, at the same time division timing, the nozzles in a certain driving block of the inner block nozzle row 601*b* can be driven simultaneously with the nozzles in the same driving block of the outer block nozzle row 601*d*.

However, if the nozzles in the inner and outer nozzle rows which belong to the same driving block (these nozzles are hereinafter referred to as the "large and small nozzles of the same driving block") are simultaneously driven, parallel circuits for the nozzles offer a reduced heater resistance. Thus, in connection with the voltage division relationship with the other wire resistance portions, introduced energy may be extremely insufficient. A known method for avoiding simultaneous driving of the large and small nozzles in the same block is what is called a toggle driving method of alternately driving the inner and outer nozzle rows.

The cyan, magenta, and yellow ink ejecting nozzle rows are configured similarly to the black ink ejecting nozzle row.

In the present example, ink can be ejected over a scan with of 1/600 inch in the main scanning direction by means of a time division driving method with 32 time divisions.

Figure 22:
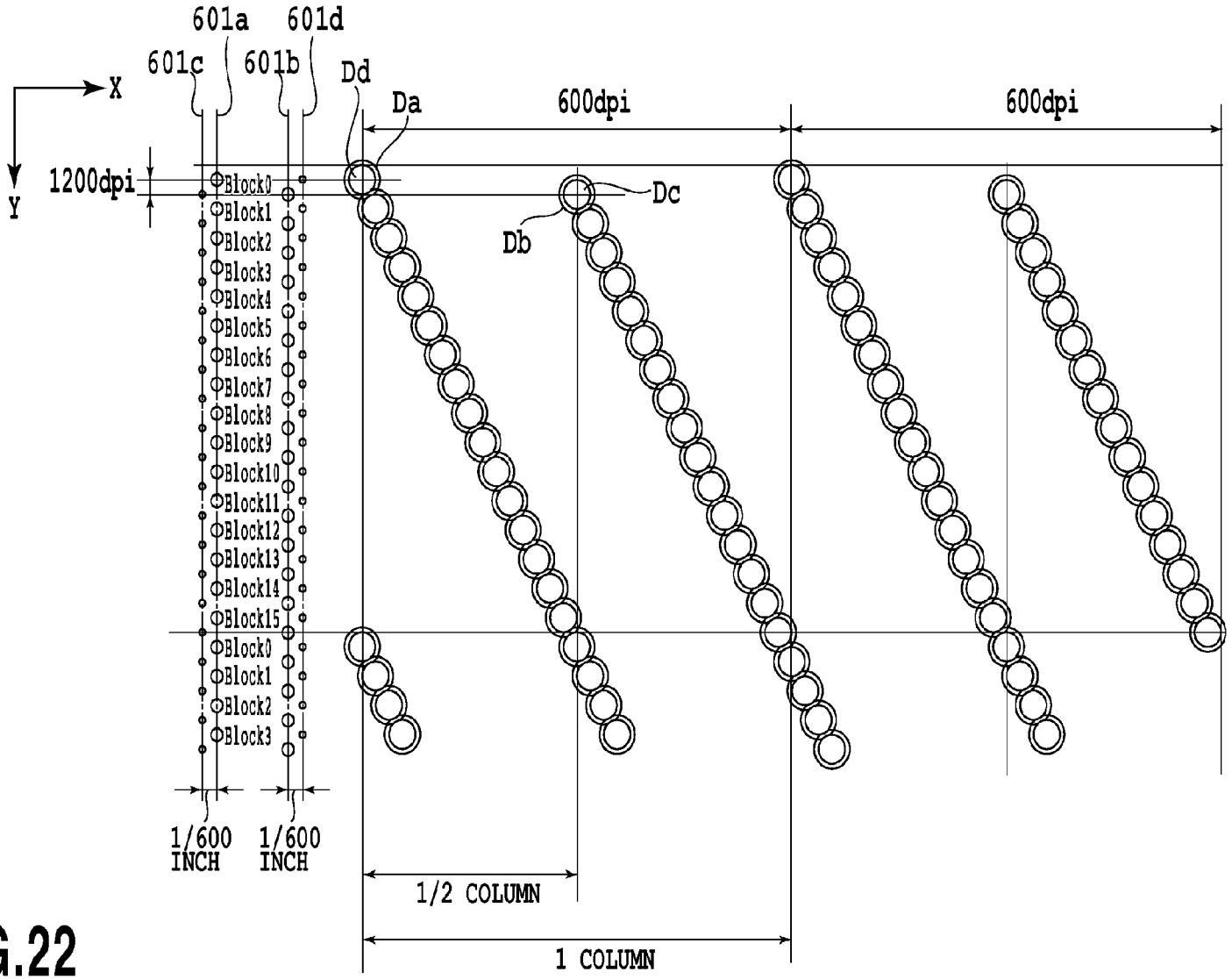
FIG. 22 is a diagram illustrating an example of a toggle driving method for the print head.
Figure 23:
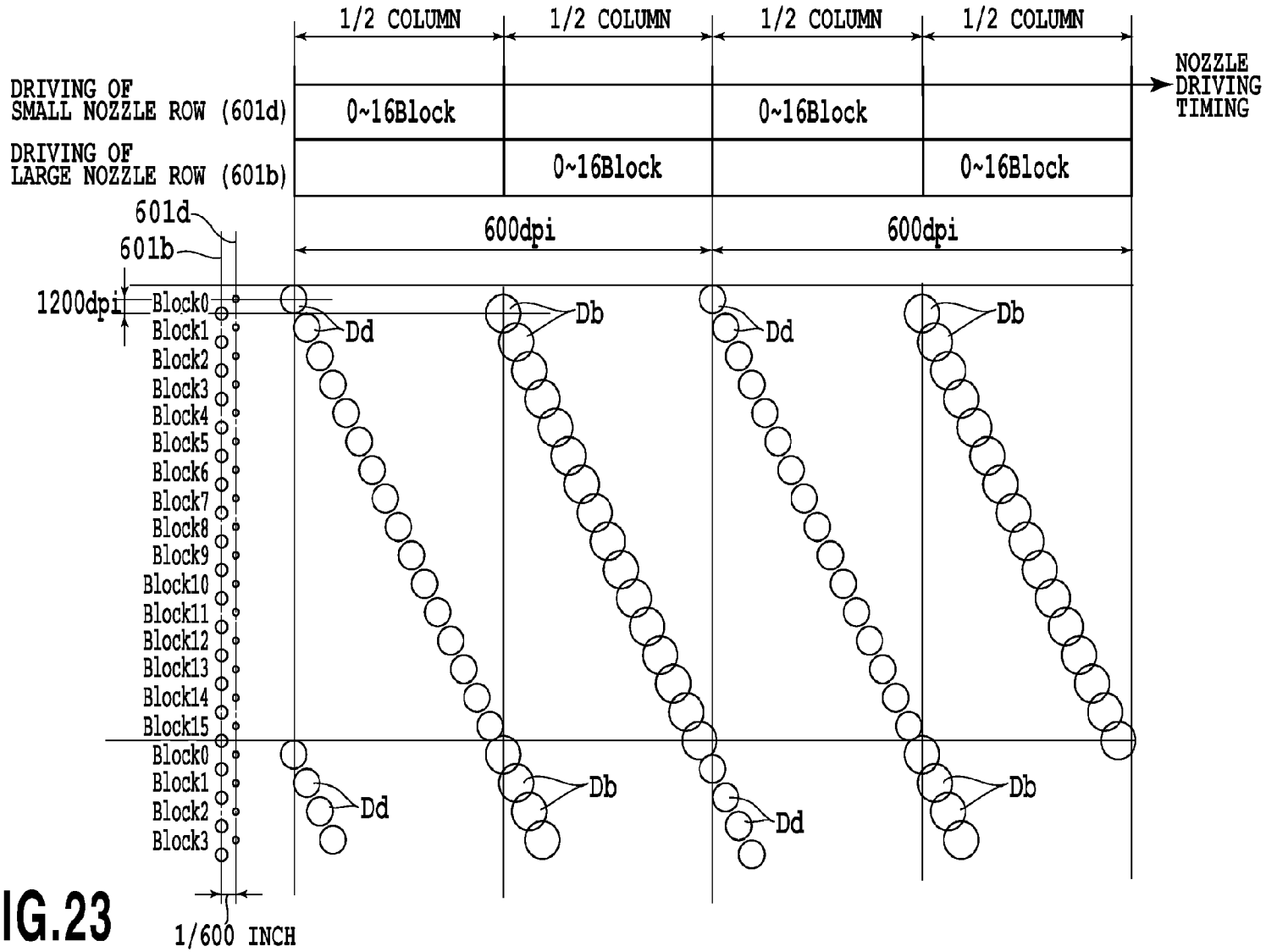
FIG. 23 is a diagram illustrating driving timings for the two nozzle rows in FIG. 22.

FIGS. 22 and 23 are diagrams illustrating an example of a toggle driving method.

In the present example, as shown in FIG. 22, the even-numbered nozzle rows 601*a* and 601*b* are driven during printing of a first half of one column (32 time divisions). Thus, large ink droplets are ejected through the even-numbered nozzle row 601*a* to form large dots Da. Small ink droplets are ejected through the even-numbered nozzle row 601*d* to form small dots Dd. During printing of a second half of the column, the odd-numbered nozzle rows 601*b* and 601*c* are driven. Thus, large ink droplets are ejected through the odd-numbered nozzle row 601*b* to form large dots Db. Small ink droplets are ejected through the even-numbered nozzle row 601*c* to form small dots Dc. With the toggle driving method in the present example, for the first half column, the blocks 0 to 15 in the even-numbered nozzle rows 601*a* and 601*b* are driven. For the second half column, the blocks 0 to 15 in the odd-numbered nozzle rows 601*b* and 601*c* are driven. FIG. 23 is a diagram illustrating driving timings for the even-numbered nozzle row 601*d*, a small nozzle row, and the odd-numbered nozzle row 601*b*, a large nozzle row.

The toggle driving method in the present example is also referred to as a column toggle method. The cyan, magenta, and yellow ink ejecting nozzle rows can be driven similarly to the black ink ejecting nozzle row.

Figure 24:
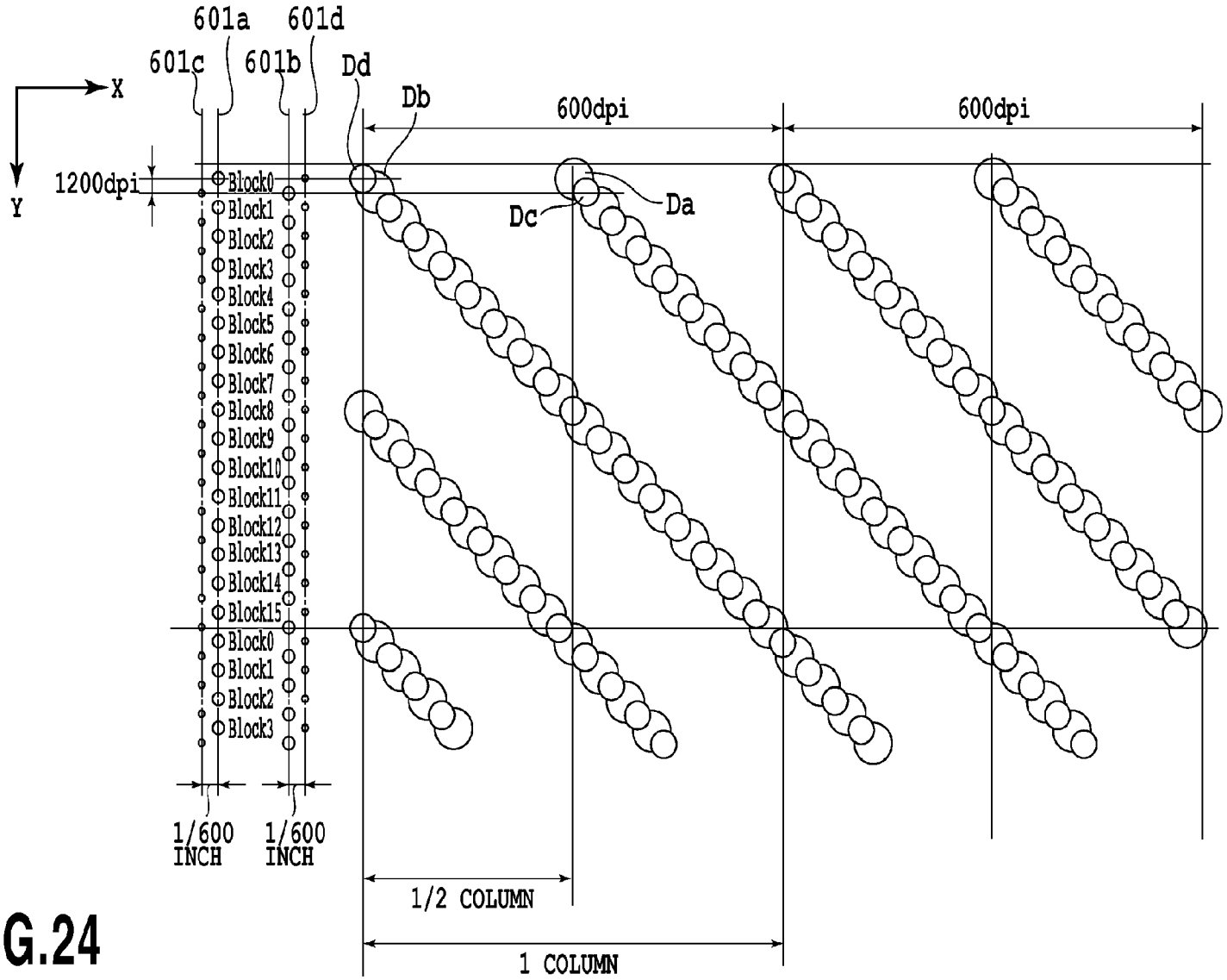
FIG. 24 is a diagram illustrating another example of the toggle driving method for the print head.
Figure 25:
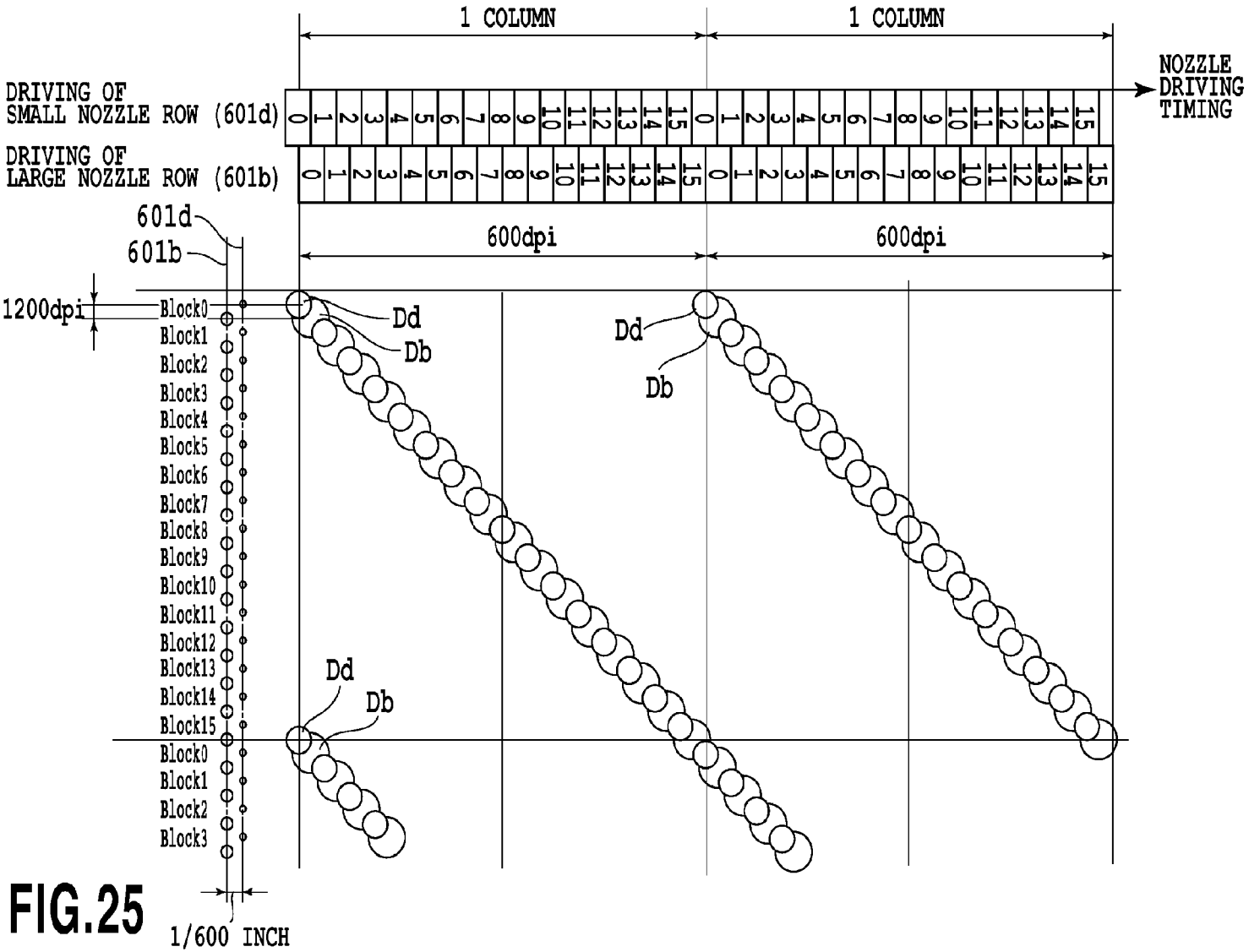
FIG. 25 is a diagram illustrating driving timings for the two nozzle rows in FIG. 24.

FIGS. 24 and 25 are diagrams illustrating another example of the toggle driving method.

In the present example, as shown in FIG. 24, within one column time-divided into 32 pieces, the inner nozzle row 601*b* and the outer nozzle row 601*d* are alternately driven at a 1/32 time division timing. The inner nozzle row 601*a* and the outer nozzle row 601*c* are alternately driven at a 1/32 time division timing. For example, the nozzle rows 601*d* and 601*b* are driven in order of the block 0 in the nozzle row 601*d*, the block 0 in the nozzle row 601*b*, the block 1 in the nozzle row 601*d*, the block 1 in the nozzle row 601*b*, . . . the block 15 in the nozzle row 601*d*, the block 15 in the nozzle row 601*b*, the block 0 in the nozzle row 601*d*, the block 0 in the nozzle row 601*b*, . . . . The nozzle rows 601*c* and 601*a* are similarly driven. Such a toggle driving method is also referred to as a block toggle method because each nozzle row is driven in order of the blocks 0 to 15. The cyan, magenta, and yellow ink ejecting nozzle rows can be driven similarly to the black ink ejecting nozzle row.

Now, description will be given of a method of printing an image according to the above-described toggle driving method.

Figure 26:
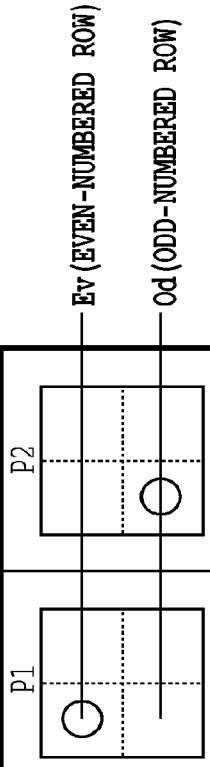
FIG. 26 is a diagram illustrating a dot matrix pattern.
Figure 26:
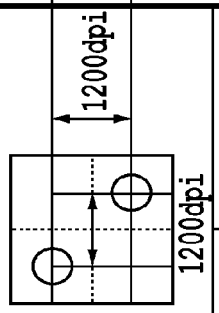
Figure 26:
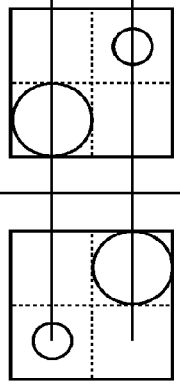
Figure 26:
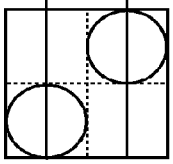

Multi-value gradation level images can be printed by assigning dot matrix patterns ("index patterns") to print data of quantized multi-value levels. For example, if a dot matrix pattern area (unit print area) is a 2×2 pixel area as shown in FIG. 26, the quantized multi-value levels and the dots to be formed in the dot matrix pattern area can be set to have the following relationship.

Level 1: one small dot is formed

Level 2: two small dots are formed

Level 3: one small dot and one large dot are formed

Level 4: two large dots are formed

Similarly, level 5 and higher levels can be associated with the number of dots formed.

At level 1, a highlight area of an image is printed. Thus, if the unit print area is a 2×2 pixel area, two dot matrix patterns P1 and P2 (see FIG. 26) are used so as to distribute dots to an areas above and below. Such assignment of the dots can be performed by a process of switching the dot matrix patterns P1 and P2 when data is generated (this process is also referred to as a "distribution process"). Such assignment of the dots enables the use frequencies of the nozzles to be made uniform. At level 2 or higher, parts of the image including the highlight area and a halftone area is printed. If the unit print area is a 2×2 pixel area, the dots are obliquely distributed over the print area in order to efficiently increase the coverage of ink on the print area.

Thus arranging the dots reduces the graininess feeling of the highlight area of the image. In the halftone area, even if the positions where the dots are formed are displaced in the main scanning direction and in the sub-scanning direction, it is possible to minimize the generation of stripes or density unevenness on the print medium. Acceptable images can thus be printed.

With the above-described column and block toggle driving methods, if focus is placed on a certain nozzle, the driving timing for the nozzle is given once for each column (one column period).

Consequently, when the dot matrix patterns P1 and P2 are switched to implement the dot arrangement of level 1, the dots formed by the odd-numbered row are formed in a left bank. This prevents the ideal dot arrangement of level 2 from being implemented. On the other hand, when an attempt is made to implement the ideal dot arrangement of level 2, the dots formed by the odd-numbered row are formed in a right bank. This prevents the dot arrangement of the dot matrix pattern P2 from being implemented. As a result, the process of distributing the dot matrix patterns P1 and P2 cannot be executed at level 1.

The dot matrix pattern in FIG. 26 is the ideal dot matrix pattern for the case in which the unit print area is a 2×2 pixel area. The dot arrangements of levels 1 and 2 in FIG. 26 cannot be implemented unless the nozzle driving timing is given twice for each column, that is, unless a ½ column period is used. If focus is placed on the dots formed by the odd-numbered row, the matrix pattern P2 of level 1 arranges the dots in the left bank of the 2×2 addresses, while the matrix pattern of level 2 arranges the dots in the right bank of the 2×2 addresses.

Two elements, a first element and a second element, are required to implement the dot arrangements described above.

Figure 27:
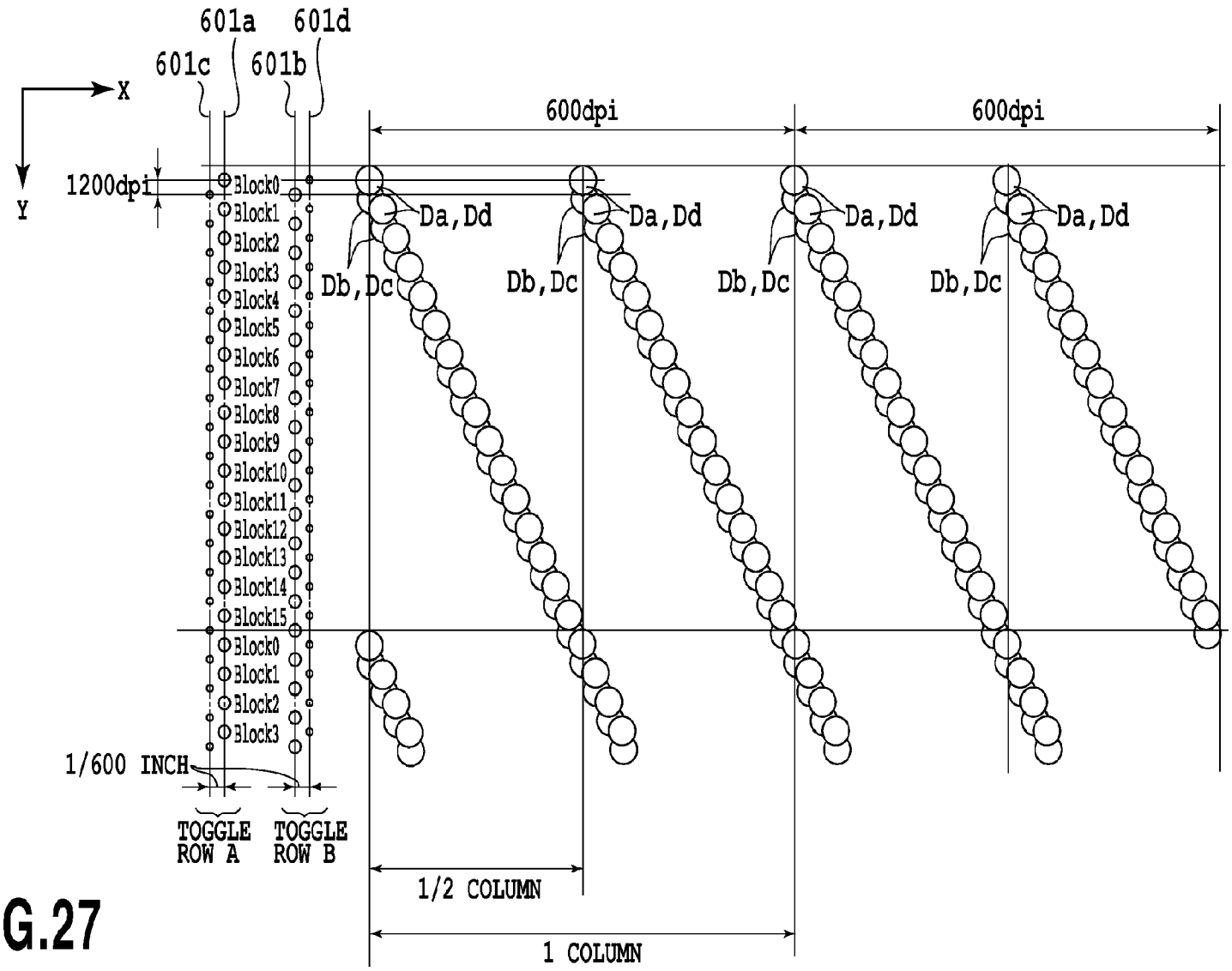
FIG. 27 is a diagram illustrating yet another example of the toggle driving method for the print head.
Figure 28:
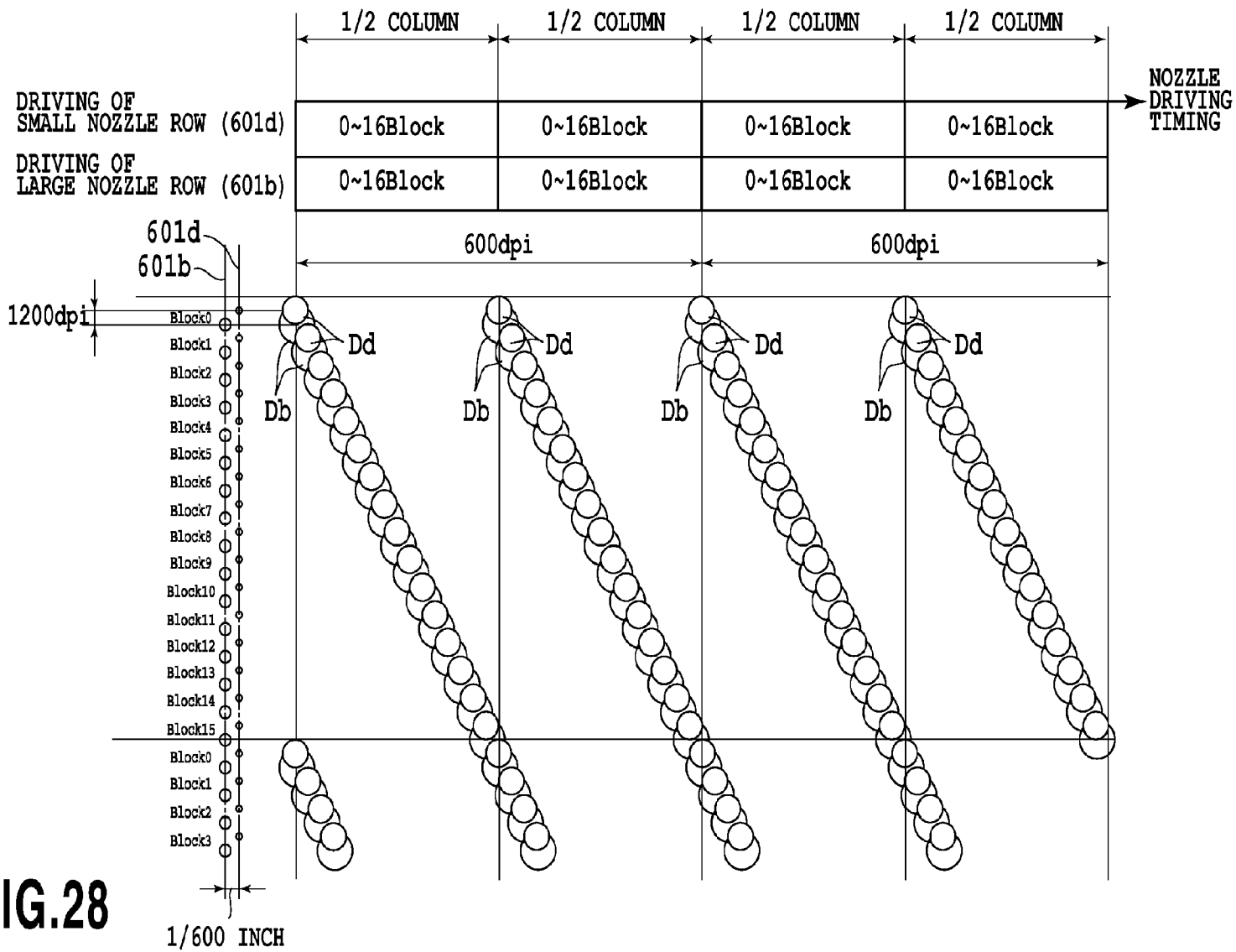
FIG. 28 is a diagram illustrating driving timings for the two nozzle rows in FIG. 27.

The first element is that the driving timing for all the nozzles is twice for each column, that is, a half column period is used as shown in FIG. 27.

However, when the driving frequencies of all the nozzles are simply increased to set the driving timing to twice for each column for all the nozzles, the nozzles in the same driving block are simultaneously driven. This reduces the heater resistance of the parallel circuit for the nozzles.

Thus, the second element is that when the large and small dots in the unit print area are formed by the large and small nozzle rows in the same driving block, the nozzles in the large and small nozzle rows which belong to the same driving block are prevented from being simultaneously driven.

The second element can be realized by offsetting the mask patterns as is the case with the first embodiment, described above, taking into account the complementary relationship between the nozzle rows and the variation in ink ejection timing, according to each toggle method. For example, it is possible to use different mask patterns for the large and small nozzle rows 601*b* and 601*d* during the same print scan and to offset the mask patterns taking into account the amount of the displacement between the nozzle rows in the scanning direction, as is the case with the first embodiment, described above. The nozzles in the nozzle rows 601*b* and 601*d* which belong to the same block can form the pixels in the same unit print area (in the same dot matrix pattern area).

Thus, even with the toggle driving method, the number of nozzles to be simultaneously driven can be reduced. Therefore, as is the case with the above-described embodiments, a possible variation in driving voltage can be inhibited to allow the ink to be stably ejected. The number of nozzles (heaters) to be simultaneously driven can be reduced to maintain a short driving pulse width.

Third Embodiment

In the first embodiment, the mask patterns are offset according to the physical positional displacement of the nozzle rows in the main scanning direction. In contrast, the present embodiment is characterized by offsetting the mask patterns according to print position adjustment values for the nozzle rows. The configuration of the print head according to the present embodiment is the same as that according to the first embodiment, shown in FIG. 6.

In the ink jet printing apparatus, dots printed using a certain nozzle row may be displaced from dots printed using a different nozzle row (print position displacement) resulting in image defects such as stripes or density unevenness. Thus, to adjust the print position displacement, the present embodiment controllably prints a plurality of patterns on the print medium, determines an adjustment value from, for example, density information obtained from the printed patterns, and on the basis of the adjustment value, adjusts the timing for ejecting ink droplets. More specifically, a plurality of patterns are printed with which the dots formed using one of the nozzle rows have a relative positional displacement amount different from that of the dots formed using the other nozzle row. Then, an optical sensor provided in the printing apparatus measures the optical characteristics (for example, the reflective optical density) of the printed patterns to obtain information on the optical characteristics of the respective plural printed patterns to acquire the adjustment value. On the basis of the adjustment value, the timing for ejecting ink through one of the nozzle rows is changed to adjust the relative positional displacement of the dots formed using the respective nozzle rows.

In the present example, among the nozzle rows in the print head shown in FIG. 6, the black-ink-ejecting even numbered nozzle row 601*a* and odd numbered nozzle row 601*b* are adjusted for the print position displacement by offsetting the mask patterns. As shown in FIG. 13, the nozzle rows 601 and 601*b* each have 16 nozzles formed therein and are displaced from each other in the main scanning direction by three pixels.

Furthermore, printing is performed by the 4-pass printing method using the nozzle rows 601*a* and 601*b*. The mask patterns A, B, C, and D shown in FIGS. 14A to 14D are used to divide the print data in association with the nozzle rows 601*a* and 601*b*. For the nozzle row 601*a*, the mask patterns are used in order of A, B, C, and D; the mask pattern A is used during the first scan. For the nozzle row 601*b*, the mask patterns are used in order of C, D, A, and B; the mask pattern C is used during the first scan.

Figure 29A:
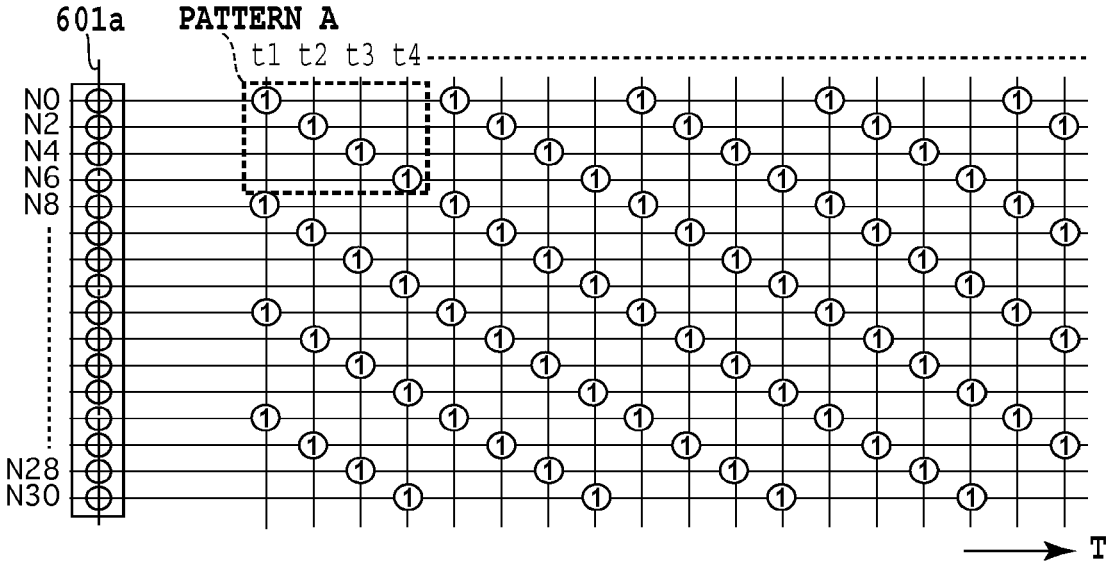
FIG. 29A is a diagram illustrating the driving form of the even-numbered nozzle row during the first scan.
Figure 29B:
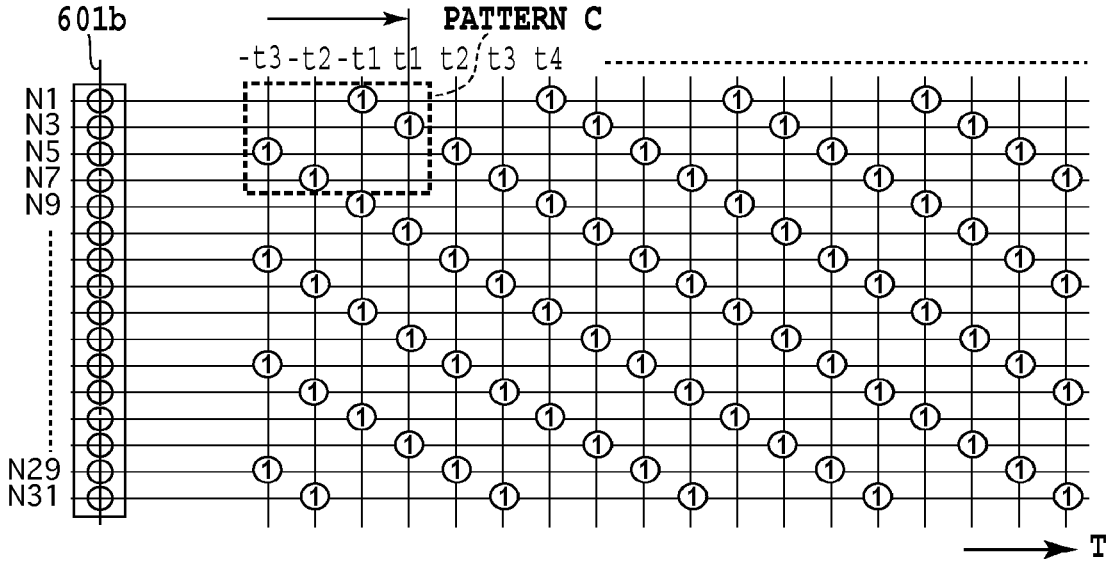
FIG. 29B is a diagram illustrating the driving form of the odd-numbered nozzle row during the first scan according to a first embodiment of the present invention.

FIGS. 29A and 29B show diving timings for the nozzle rows 601*a* and 601*b* during the first print scan. As described in the first embodiment, by using the mask patterns for the nozzle rows 601*a* and 601*b* in the above-described order, it is possible to drive the nozzle rows 601*a* and 601*b* in the different blocks at all of the points in time t1, t2, t3, . . . .

However, when the dots printed using the nozzle row 601*a* are displaced from the dots printed using the nozzle row 601*b* and the ejection timing (driving timing) for one of the nozzle rows is changed to adjust the displacement, the nozzle rows 601*a* and 601*b* in the same block may be drive. This problem will be described below.

The nozzle rows 601*a* and 601*b* are displaced from each other in the main scanning direction by three pixels. Thus, without the print position displacement, the dots printed at a certain timing using the nozzle row 601*a* are displaced, by three pixels, from the dots printed at the same timing using the nozzle row 601*b*. However, a manufacture error or the like in the printing apparatus may disturb the relative positional relationship between the dots printed using the nozzle row 601*a* and the dots printed using the nozzle row 601*b*. For example, the dots printed at a certain timing using the nozzle row 601*a* may be displaced, by two pixels, from the dots printed at the same timing using the nozzle row 601*b*.

To adjust the print position displacement, the conventional art acquires an adjustment value required to adjust the print position displacement from a test pattern printed on print paper so as to change the ejection timings for one of the nozzle rows on the basis of the adjustment value.

For the above-described print position displacement, the ejection timings for the nozzle row 601*b* need to be delayed by an amount equal to one pixel in order to adjust the displacement between the dots printed using the nozzle rows 601*a* and 601*b* in the main scanning direction, to three dots. That is, for the nozzle row 601*b*, the dots printed at a timing –t3 are printed at a timing –t2, and the dots printed at a timing –t2 are printed at a timing –t1. Thus, after the change in ejection timings, the dots printed using the nozzle row 601*b* are displaced in the scan progressing direction by one pixel. This makes it possible to adjust the displacement between the print positions of the nozzle rows 601*a* and 601*b* in the main scanning direction, to three dots.

Figure 29C:
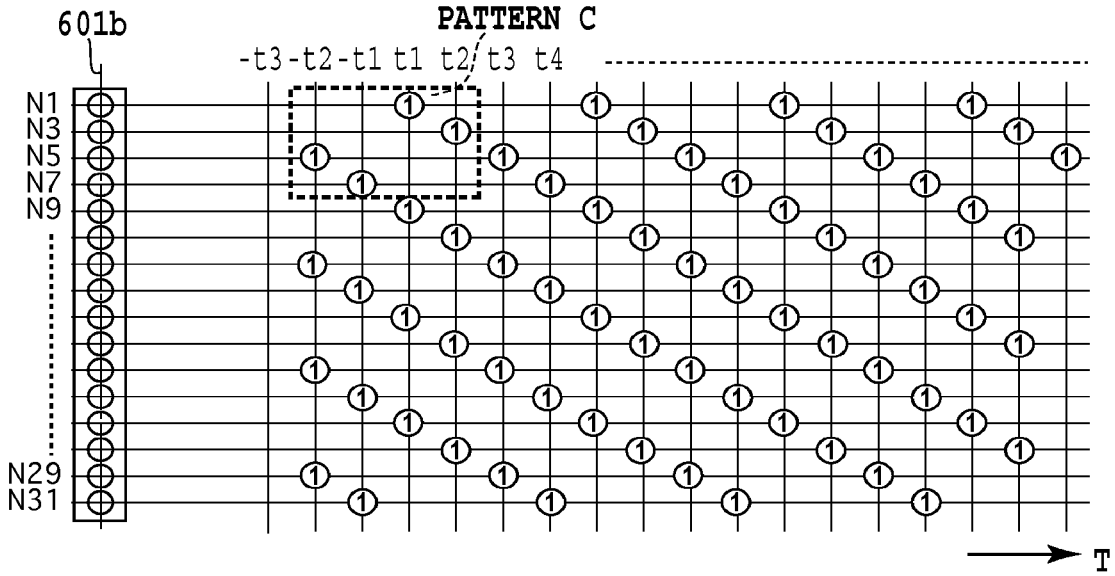
FIG. 29C is a diagram illustrating the driving form of the odd-numbered nozzle row during the first scan after a change in timing.

FIG. 29C shows the changed driving timings for the nozzle row 601*b* during the first print scan. Thus, as shown in FIG. 29C, the ejection timings are changed such that the dots printed at the timing –t3 before the change (FIG. 29B) are printed at the timing –t2 and such that the dots printed at the timing –t2 before the change (FIG. 29B) are printed at the timing –t1.

Here, the driving timings for the nozzle row 601*a* shown in FIG. 29A are compared with the driving timings for the nozzle row 601*b* shown in FIG. 29C and obtained as a result of the print position adjustment. The comparison indicates that the same blocks are driven at all the timings. In this manner, when the ejection timings (driving timings) for one of the nozzle rows are changed to adjust the print position displacement between the nozzle rows, the exclusive relationship between the mask patterns may not be maintained between the nozzle rows.

Thus, the present embodiment offsets the mask patterns according to the print position adjustment value for the nozzle rows.

In FIGS. 30A to 30D, mask patterns C(−1), D(−1), A(−1), and B(−1) are obtained by offsetting the mask patterns C, D, A, and B by one pixel corresponding to the change in the ejection timing for the nozzle row 601*b* (the adjustment value for the print position displacement). Here, the ejection timings are delayed by an amount equal to one pixel according to the print position displacement. Thus, pixels on each of the mask patterns for which ink ejection is permitted are shifted leftward by one pixel. The mask patterns C(−1), D(−1), A(−1), and B(−1) are obtained by shifting the read start positions of the mask patterns C, D, A, and B by one pixel.

Figure 29D:
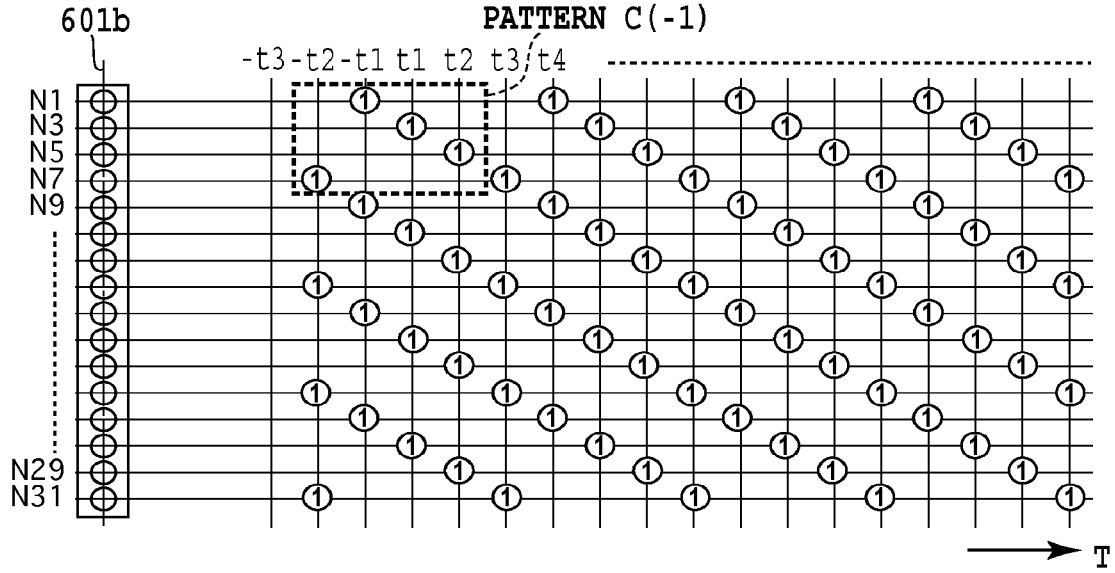
FIG. 29D is a diagram illustrating the driving form of the odd-numbered nozzle row during the first scan according to a third embodiment of the present invention.
Figure 30A:
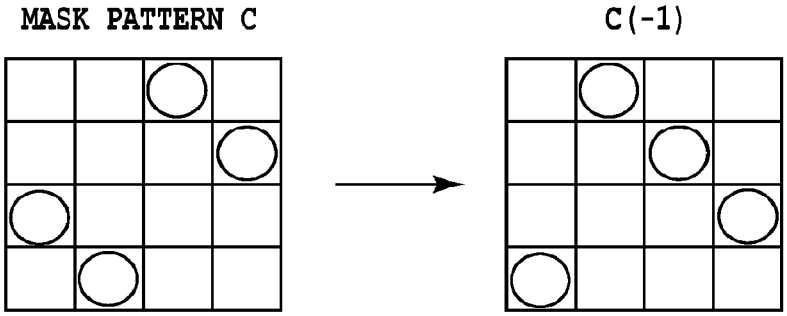
FIGS. 30A to 30D are diagrams illustrating the conditions of the mask patterns A to D before and after offset according to the third embodiment of the present invention.
Figure 30B:
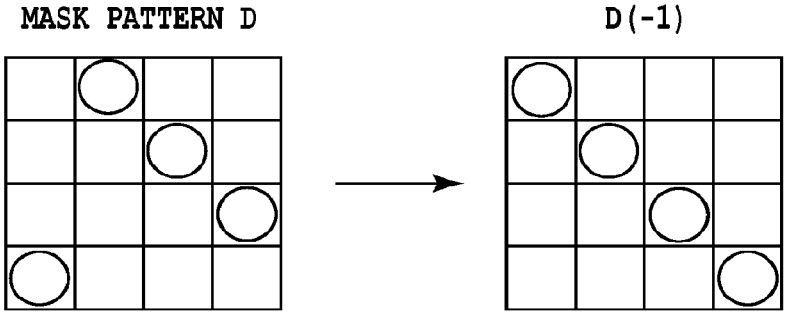
Figure 30C:
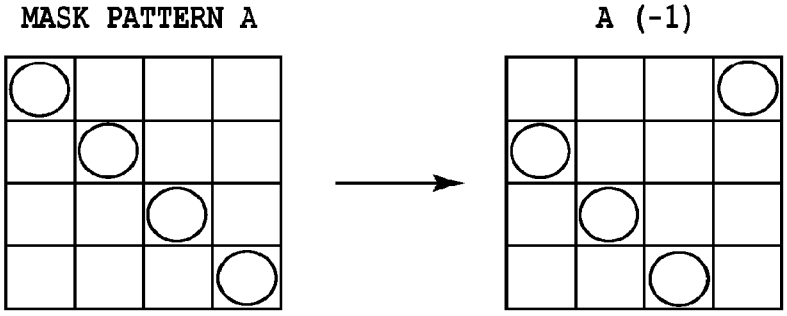
Figure 30D:
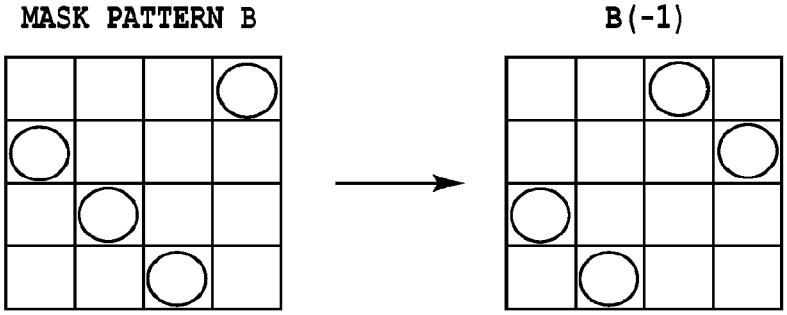

FIG. 29D is a diagram showing driving timings provided during the first print scan when the mask pattern C(−1) is applied to the nozzle rows 601*b* for which the print positions have been adjusted (the ejection timings have been changed). Thus, the use of the offset mask pattern C(−1) maintains the exclusively complementary relationship between the mask patterns A and C(−1). Consequently, the nozzles in the nozzle row 601*a* which belong to a certain driving block are not driven simultaneously with the nozzles in the nozzle row 601*b* which belong to the same driving block. This also applies to the cases in which the mask patterns D(−1), A(−1), and B(−1) are used during the second, third, and fourth print scans, respectively. Thus, the number of nozzles to be simultaneously driven can be reduced to inhibit a possible variation in driving voltage to allow the ink to be stably ejected. Furthermore, the number of nozzles (heaters) to be simultaneously driven can be reduced to maintain a short driving pulse width.

As described above, even when the mask patterns for the respective nozzle rows are designed according to the physical positional displacement between the nozzle rows, the adjustment of the print position displacement may cause the same block in the plurality of nozzle rows to be simultaneously driven. However, the present embodiment offsets the mask patterns according to the adjustment value required to adjust the print position displacement. This enables a reduction in the number of nozzles (heaters) to be simultaneously driven.

Other Embodiments

In the first embodiment, when the nozzle rows 601*a* and 601*b* are displaced from each other in the main scanning direction by three pixels, the mask patterns used for the nozzle row 601*b* are displaced by three pixels. However, the amount by which the nozzle row is displaced need not be adopted as the amount by which the mask patterns are to be displaced (offset), as it is. For example, in the first embodiment, even mask patterns C(2), D(2), A(2), and B(2) obtained by shifting the original mask patterns rightward by two pixels maintain the exclusive relationship between the nozzle rows 601*a* and 601*b*.

Furthermore, the above-described embodiments show the configuration in which the read start positions of the mask patterns for each scan are offset according to the physical displacement between the nozzle rows or the print position adjustment value. However, it is possible to prepare a plurality of mask patterns used to divide the print data among the scans, in the memory (ROM) and to change the order in which the mask patterns are used, according to the physical displacement between the nozzle rows or the print position adjustment value. For example, in the first embodiment, for the nozzle row 601*b*, if the mask patterns are determined to be used in order of B, C, D, and A during four scans, the order of the mask patterns used during the respective scans is changed to C, D, A, and B according to the amount of displacement between the nozzle rows.

Furthermore, in the above-described embodiments, the mask patterns that are complementary to one another among the scans are used in order to divide the print data among the plurality of scans. However, the mask patterns applicable to the present invention are not limited to those which are complementary to one another among the scans. For example, mask patterns may be used which allow print data with a total ink ejecting rate of 150% to be divided among a plurality of scans. The total ink ejecting rate is a proportion of the number of times of ejecting ink to a unit print area during the plurality of scans, to the number of pixels in the unit print area. In this case, the complementary and exclusive relationship is not maintained among the mask patterns for multi-pass printing. Thus, the nozzles belonging to the same driving block may be simultaneously driven. In this case, the mask patterns used during the respective scans may be set so as to reduce the number of nozzles in the same driving block which are simultaneously driven.

That is, according to the present invention, the read positions or use order of the mask patterns may be changed according to the amount of the physical displacement between the nozzle rows or the adjustment value for the print positions so as to reduce the number of nozzles to be simultaneously driven.

In the description of the example in the above-described embodiments, if the two nozzle rows are displaced in the main scanning direction by an integral multiple of the size of one print pixel, the mask patterns used for one of the nozzle rows are offset in the raster direction by the amount of the displacement. However, the amount of the displacement between the nozzle rows is not necessarily limited to an integral multiple of the size of one print pixel. For example, if the displacement amount is less than the size of one pixel, it is possible to avoid offsetting the masks patterns when the displacement amount is smaller than a predetermined threshold, while offsetting the mask patterns by one pixel when the displacement amount of equal to or larger than the predetermined threshold. If the displacement amount is 2.6 pixels, the offset amount of the mask patterns can be set to two or three pixels on the basis of the relationship with the predetermined threshold.

Furthermore, when the two nozzle rows are defined as a first nozzle row and a second nozzle row, either the mask patterns for the first nozzle row or the mask patterns for the second nozzle row may be displaced in the raster direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-181352, filed Jul. 10, 2007, which is hereby incorporated by reference herein in its entirety.

What is claimed is:

1. An image processing apparatus for processing an image to be printed on a print medium by ejecting ink from a print head in which at least a first element array, in which a plurality of elements used for ejecting ink are arrayed in an arraying direction, and a second element array, in which a plurality of elements used for ejecting ink are arrayed in the arraying direction, are arranged in a crossing direction which crosses the arraying direction, said image processing apparatus comprising:

a scanning unit configured to scan the print head plural times in the crossing direction relative to a unit area of the print medium, a conveying unit configured to convey the print medium in a conveying direction which crosses the crossing direction such that each of a plurality of element groups, which comprise a predetermined number of elements continuously arrayed in the arraying direction in the first element array and the second element array, faces the unit area in each of the plurality of scans, a driving control unit configured to control driving the plurality of elements in the first and second element arrays so as to be driven at different timings from each other with respect to each of driving blocks obtained by dividing the plurality of elements in the first and second element arrays, an obtaining unit configured to obtain an ink ejection data corresponding to the image to be printed on the unit area, a generating unit configured to generate a plurality of print data, each of which is used for ejecting ink from each of the plurality of element groups in each of the plurality of scans, based on the ink ejection data obtained by the obtaining unit by using a plurality of first mask patterns corresponding to the plurality of element groups in the first element array and a plurality of second mask patterns corresponding to the plurality of element groups in the second element array, and an ejecting control unit configured to control ejecting ink by causing the print head to drive the plurality of elements in the first and second nozzle array by the driving control unit based on the plurality of print data generated by the generating unit, wherein in each of the plurality of first and second mask patterns, print permitting pixels which permit ink to be ejected to pixel areas in the unit area from the print head and non-print permitting pixels which do not permit ink to be ejected to the pixel areas from the print head are arranged, and wherein the plurality of first and second mask patterns are determined such that elements in the first element array and the elements in the second element array belonging to the same driving block are not driven at a same timing by the driving control unit.

2. The image processing apparatus according to claim 1, wherein the first element array and the second element array are arranged at different positions deviated from each other in the arraying direction.

3. The image processing apparatus according to claim 2, wherein one of the elements in the second element array is arranged at a position between one of the elements in the first element array and an adjacent element in the arraying direction, the adjacent element adjoining to the one of the elements in the first element array.

4. The image processing apparatus according claim 3, wherein an amount of ink ejected from each of the plurality of elements in the second element array is smaller than an amount of ink ejected from each of the plurality of elements in the first element array.

5. The image processing apparatus according to claim 1, wherein, in each of the plurality of first mask patterns, numbers of the print permitting pixels arranged in each of rasters are substantially same, each raster extending in the crossing direction in each of the plurality of first mask patterns.

6. The image processing apparatus according to claim 5, wherein each of the plurality of second mask patterns has a same arrangement of print permitting pixels as one of the plurality of first mask patterns.

7. The image processing apparatus according to claim 1, wherein the print permitting pixels in the plurality of first mask patterns are exclusive and have a complementary relationship with each other, and wherein the print permitting pixels in the plurality of second mask patterns are exclusive and have a complementary relationship with each other.

8. The image processing apparatus according to claim 1, wherein elements in the second element array belonging to the same driving block are positioned at substantially same positions as elements in the first element array belonging to the same driving block in the arraying direction.

9. The image processing apparatus according to claim 1, wherein the plurality of elements in the first element array and the plurality of elements in the second element array are used for ejecting same color ink.

10. The image processing apparatus according to claim 1, further comprising:

a memorizing unit configured to memorize a plurality of base mask patterns corresponding to the plurality of element groups, wherein in each of the plurality of base mask patterns, print permitting pixels and non-print permitting pixels are arranged, and a mask pattern generating unit configured to generate the plurality of first mask patterns and the plurality of second mask patterns based on the plurality of the base mask patterns memorized by the memorizing unit.

11. The image processing apparatus according to claim 10, wherein the mask pattern generating unit generates each of the plurality of first mask patterns by retrieving each of the plurality of base mask patterns at a first retrieving position in the crossing direction and generates each of the plurality of second mask patterns by retrieving each of the plurality of base mask patterns at a second retrieving position which is different from the first retrieving position in the crossing direction.

* * * * *